US006899414B2

(12) United States Patent
Kondoh et al.

(10) Patent No.: US 6,899,414 B2
(45) Date of Patent: May 31, 2005

(54) PRINTHEAD AND RECORDING DEVICE ARRANGED WITH THE PRINTHEAD

(75) Inventors: Yoshinao Kondoh, Ebina (JP); Kohta Nakayama, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/625,515

(22) Filed: Jul. 24, 2003

(65) Prior Publication Data

US 2004/0196328 A1 Oct. 7, 2004

(30) Foreign Application Priority Data

Dec. 11, 2002 (JP) ..... 2002-359945

(51) Int. Cl.[7] ..... B41J 2/145; B41J 2/15; B41J 29/38

(52) U.S. Cl. ..... 347/40; 347/12

(58) Field of Search ..... 347/12, 57, 145, 347/180, 40

(56) References Cited

U.S. PATENT DOCUMENTS 6,543,892 B2 * 4/2003 Kubota et al. ..... 347/109
2001/0045967 A1 * 11/2001 Hayasaki ..... 347/9
2002/0118241 A1 * 8/2002 Fujii ..... 347/12

FOREIGN PATENT DOCUMENTS

| | | |
|---|---|---|
| JP | 62-77951 | 4/1987 |
| JP | 5-238004 | 9/1993 |
| JP | 6-198893 | 7/1994 |
| JP | 6-305148 | 11/1994 |
| JP | 9-327914 | 12/1997 |

* cited by examiner

*Primary Examiner*—Thinh Nguyen
(74) *Attorney, Agent, or Firm*—Morgan Lewis & Bockius LLP

(57) ABSTRACT

A printhead includes plural print elements grouped in blocks. The blocks are selected by a block selection unit to which an initial value is inputted. The initial value is kept in a memory unit, and the blocks are autonomously and periodically selected by the initial value kept in the memory unit. The initial value is variable, and the block selection unit changes the order of selected blocks using the changed initial value. Thus, displacement in the main scanning direction resulting from the periodically selected blocks can be eliminated.

22 Claims, 36 Drawing Sheets

$W_S > W_P$

FIG. 11

| BLOCK NUMBER | ALLOCATED ELEMENT NUMBERS |
|---|---|
| 1 | 1, 9, 17, 25 |
| 2 | 2, 10, 18, 26 |
| 3 | 3, 11, 19, 27 |
| 4 | 4, 12, 20, 28 |
| 5 | 5, 13, 21, 29 |
| 6 | 6, 14, 22, 30 |
| 7 | 7, 15, 23, 31 |
| 8 | 8, 16, 24, 32 |

FIG. 28

| SELECTION ORDER | *ELEMENT NUMBERS |
|---|---|
| 1 (8) | 1, 9, 17 |
| 2 (7) | 4, 12, 20 |
| 3 (6) | 7, 15, 23 |
| 4 (5) | 2, 10, 18 |
| 5 (4) | 5, 13, 21 |
| 6 (3) | 8, 16, 24 |
| 7 (2) | 3, 11, 19 |
| 8 (1) | 6, 14, 22 |

PRINTHEAD AND RECORDING DEVICE ARRANGED WITH THE PRINTHEAD

CROSS-REFERENCE TO RELATED APPLICATION

This application claims priority under 35 USC 119 from Japanese Patent Application No. 2002-359945, the disclosure of which is incorporated by reference herein.

BACKGROUND OF THE INVENTION

1. Field of the Invention

The present invention relates to a printhead and a recording device arranged with the printhead, and in particular to a printhead for realizing high speed and high image quality and a recording device arranged with the printhead.

2. Description of the Related Art

Conventionally, with respect to printer printheads that use thermal energy or the like to conduct image recording, printheads that form dots by scattering liquid ink as small drops (so-called liquid drops) onto a recording medium to record an image are known. Printers that record an image by forming dots using a printhead such as a thermal head that supplies thermal energy to a heat-sensitive recording medium are also known.

In recent years, a printer arranged with plural printheads has been practically applied with the object of obtaining a multicolor image with a high resolution and at a high speed. In this printer, a multicolor image can be obtained by making the printheads correspond per color and overlapping the color images in order to obtain an image corresponding to the respective colors. In this case, because displacement of elements between the printheads leads to color displacement and to low resolution, positions between the plural printheads, i.e., the positions of dots to be formed by the respective printheads, must be aligned with high precision.

Thus, in a recording device having plural printheads having numerous nozzles that discharge liquid ink drops, in a case where the printheads are plurally arranged in a direction (main scanning direction) orthogonal to the arranging direction (subscanning direction) of the nozzles, technology where positional displacement in regard to the subscanning direction of dots to be formed between the printheads is corrected (referred to below as subscanning registration correction) has been disclosed (e.g., see Patent Document 1: Japanese Patent Application Laid-Open Publication (JP-A) No. 62-077951, pp. 2–3 and FIG. 2). In this technology, the printheads are fixed, and common nozzle groups between a fixed number of printheads that is less than the number of mounted nozzles are used.

However, positional displacement in regard to the main scanning direction of the dots to be formed between the printheads (referred to below as main scanning registration correction) cannot be corrected with this technology by itself.

As another example of subscanning registration correction, technology has also been disclosed where each of plural printheads is mechanically and movably created and each of the printheads is moved, whereby displacement is corrected (e.g., see Patent Document 2: JP-A No. 05-238004, pp. 3–4 and FIG. 2). However, in this technology, because mechanical members for enabling the printheads to be movable are large, the printheads themselves become large. Thus, the application of large printheads, such as paper-width printheads, is difficult.

Incidentally, in a case where plural printheads are driven, it is necessary to effectively drive each printhead. For example, it has become possible to arrange, at a high density, nozzles and heater elements numerously arranged in the subscanning direction. By arranging numerous nozzles and heater elements at a high density, dot formation at a high density has become possible. However, a high-capacity power source is necessary in order to simultaneously drive the numerous nozzles and heater elements lined up in the subscanning direction within the printheads.

Thus, driving in the subscanning direction according to one printhead is conducted by a time division in which the drive number of nozzles and heater elements is fixed to a predetermined number and the nozzles and heater elements of that predetermined number are grouped into single blocks and driven per block. That is, the drive timing per block is slightly staggered so that the nozzles and heater elements are successively driven, whereby it has become possible to control instantaneously flowing current and it has become possible to render high-capacity power sources unnecessary.

However, when numerous nozzles and heater elements are arranged and driven, wiring increases and nozzle trouble increases. For this reason, print element driving technology has been disclosed where a counter is mounted within a semiconductor chip of an inkjet recording head unit, a clock is supplied to the counter, the counting output of the clock is internally generated as a block enable signal and the blocks are selected (e.g., see Patent Document 3: JP-A No. 06-305148, pp. 3–4 and FIG. 1). However, in this technology, because the order of block selection is fixed, the technology is not compatible with main scanning registration correction.

As another example of print element driving, technology has been disclosed where a phase-delay time between nozzles is set in order to raise the drive frequency of the nozzles (e.g., see Patent Document 4: JP-A No. 06-198893, pp. 2–3 and FIG. 3). In this technology, the nozzles are grouped into four nozzle groups every other three and each nozzle group is driven by staggering its phase with the other nozzle groups. However, in this technology, because the number of print elements per group (=number of simultaneously driven print elements) becomes large, application of this technology with respect to printheads where the number of mounted print elements is large is difficult.

Moreover, as another example of print element driving, technology has been disclosed where a decoder is mounted within a drive circuit of a recording head and the blocks are selected by an output signal of the decoder in order to reduce wiring and deter nozzle trouble (e.g., see Patent Document 5: JP-A No. 09-327914, pp. 6–7 and FIG. 7). However, in this technology, because an external signal is required each time the selected block is switched, control becomes complicated.

As described above, in each of the conventional technologies, although subscanning registration correction and print element driving are possible, it has been difficult to realize both main scanning registration correction and subscanning registration correction. That is, in each of the above-described conventional technologies, both main scanning registration correction and subscanning registration correction cannot be achieved.

For example, in a configuration that combines the above-described conventional technologies, even if a decoder is mounted, different control signals are invariably required when switching the selected block. Also, in a case where the printheads are configured so that each of plural printheads is mechanically movable, the mechanism for adjusting each printhead becomes large.

Here, it will be assumed that main scanning registration correction is possible by print element driving and that subscanning registration correction is possible by adjusting the positional relation of the printheads. The reason why main scanning registration correction is difficult in the above-described conventional technologies will be described.

It should be noted that, in order to facilitate understanding of the problems with respect to main scanning registration correction, a case will be described here where, in a recording device having plural printheads having numerous nozzles that discharge liquid ink drops, subscanning registration correction is conducted by recording using common nozzle groups between printheads of a fixed number that is less than the number of mounted nozzles and main scanning registration correction is conducted by mounting a counter within a drive circuit of a recording head and using an output signal of the counter to select the blocks.

Because drive print elements are successively driven per block, a time difference arises in the drive timing of each block. Because the printheads that are relatively main-scanned over the recording medium are in a constantly moving state during the print element driving, dots positions on the recording medium are displaced by the amount of the time difference. The displacement amount of the dot positions increases together with an increase in the main scanning speed. When each block is periodically driven at a fixed time difference, the displacement amount of the dot positions reaches a maximum.

For example, a case will be considered where, as shown in FIG. 36, the printheads are divided into eight blocks, a print element A belonging to an initially selected block plots a dot on line A on a recording medium and a print element B belonging to a finally selected block simultaneously plots a dot on line B. When a print element B of a different printhead plots a dot on line A due to subscanning registration correction, the dot is not plotted at the position represented by the solid circle on line A but is plotted at the position represented by the dotted circle because the selection order of the blocks is fixed (occurrence of main scanning registration displacement). Because the plotting print element changes in accordance with the subscanning registration amount, the displacement amount between the solid circle and the dotted circle on line A changes.

SUMMARY OF THE INVENTION

In consideration of the above-described facts, it is an object of the present invention to provide a printhead that can improve image quality by deterring positional displacement of dots that are to be formed on a recording medium between different printheads and to provide a recording device arranged with the printhead.

In order to achieve the above object, the invention has a configuration that enables high image quality by controlling displacement between different printheads both when the positions of dots to be formed on a recording medium is in the main scanning direction and in the subscanning direction. In basic conception, the printheads correct the positions of dots formed by recording elements by driving the recording elements as they are, which is fixed.

For example, with respect to the correction of positional displacement of dots to be formed by recording elements of a direction along an arranging direction of the recording elements, i.e., in subscanning registration correction, correction in the subscanning direction is possible within the printheads by using drive elements, which are recording elements, of a predetermined number that is less than the number of total recording elements mounted in the printheads. It should be noted that recording elements other than those of drive element groups can be considered as correction elements and that there may be a fixed number of correction elements regardless of the total number of recording elements mounted in the printheads. Thus, in a case where the total number of mounted recording elements is increased in order to improve printer speed, waste of recording elements can be considerably alleviated because the ratio of the number of correction elements occupying the total number of recording elements drops.

Also, with respect to the correction of positional displacement of dots to be formed in the direction intersecting the arranging direction of the recording elements, i.e., in main scanning registration correction, correction is used that autonomously and periodically switches the block selection unit as long as a stop signal from an external controller represented by a counter or the like is not inputted. In this case, the initial value for selecting the blocks is changed in accordance with the subscanning registration correction amount. By changing the initial value in this manner, the order of block selection can be simply changed and main scanning registration correction becomes simple.

Specifically, the printhead of the invention comprises: plural recording elements that are divided into plural blocks and driven per divided block; an input unit for inputting an initial value of a selection order of the blocks in order to drive the recording elements; and a selection unit that selects, on the basis of the inputted initial value, the blocks for driving the recording elements according to the selection order of the blocks.

In the invention, the plural recording elements mounted on the printhead are divided into plural blocks and driven per divided block. The initial value of the selection order of the blocks is inputted to the input unit in order to drive the recording elements. Because the selection order of the blocks is fixed by the initial value, the selection unit selects the blocks for driving the recording elements according to the selection order.

Because the initial value of the selection order of the blocks can be inputted to the printhead in this manner, the order of block selection can be simply changed.

The selection unit is characterized in that it includes a repeat selection unit that autonomously and periodically repeats the selection order using an inputted signal.

The selection unit arranged in the printhead includes the repeat selection unit, and the repeat selection unit autonomously and periodically repeats the selection order using an inputted signal such as a clock signal. When the initial value is fixed, the blocks are selected by the repeat selection unit autonomously and periodically repeating the selection order. In this case, because the initial value is variable, the order of block selection can be easily changed and main scanning registration correction becomes easy. That is, displacement in the main scanning direction that arises due to a time difference of the blocks resulting from the periodic selection is eliminated by changing the initial value.

The repeat selection unit is characterized in that it includes a synthesizing unit that generates a synthesized signal, in which enable signals of the recording elements are synthesized, and autonomously and periodically repeats the selection order using the synthesized signal.

Although it is also possible to use a dedicated signal in order to periodically select the blocks in regard to block selection, an activating enable signal is inputted to each recording element. This enable signal is almost always generated by a clock such as a standard clock. Thus, by using the synthesized signal in which all recording element enable signals, i.e., the enable signals of each of the recording elements, are synthesized, the number of input signals can be reduced and the number of printhead input pads can be reduced.

The repeat selection unit is also characterized in that includes a counter that successively counts the initial value in accordance with an inputted clock signal.

In this manner, by configuring the repeat selection unit with a counter so that it successively counts the initial value in accordance with the inputted clock signal, a simple configuration resulting from the counter is realized and autonomous and periodic block selection becomes easy.

Each recording element is characterized in that it includes a product calculation unit having, as inputs, a selection instruction signal of the selection unit, a synthesized signal of the synthesizing unit and a recording signal for recording at each element, and having, as an output, an AND operation of the inputs.

Although the recording elements belong to the blocks, it is preferable for the driving thereof to be conducted per recording element in correspondence with image data for recording or the like. Thus, the recording elements are individually driven by the product calculation unit. The product calculation unit has, as inputs, a selection instruction signal of the selection unit, a synthesized signal of the synthesizing unit and a recording signal for recording at each element, and has, as an output, an AND operation of the inputs. Thus, driving per recording element is possible.

The printhead further comprises a memory unit that keeps the initial value and outputs the kept initial value to the selection unit.

There are many cases where the selection order of the blocks is the same in regard to driving of the printhead. Thus, due to the memory unit keeping the inputted initial value with a latch function or the like and outputting the kept initial value to the selection unit, such cases are eliminated by repeatedly inputting the initial value.

When a new initial value is inputted to the memory unit, the memory unit updates the initial value to the new initial value.

Sometimes there is a demand to change the initial value kept by the memory unit to a new initial value. In this case, when a new initial value is inputted, the initial value is changed to the new initial value, whereby the kept initial value is always updated, and changing the initial value in accordance with the demand becomes possible.

The printhead further comprises a generation unit that generates, when recording elements of a number that is less than the number of the plural recording elements are set as drive elements, non-drive data for placing recording elements other than the drive elements in a non-driven state.

In paper-width printers and the like, sometimes the number of recording elements exceeds the paper width. In this case, it is preferable to set recording elements other than drive elements in a non-driven state. Thus, when recording elements of a number fewer than the number of the plural recording elements are set as drive elements, non-drive data for placing recording elements other than the drive elements in a non-driven state is generated by the generation unit. White data representing the color of the base of the recording medium is included in the non-drive data. By generating the non-drive data and driving the recording head in this manner, it is possible to easily switch, per recording element, between driving and not driving the recording elements.

The generation unit is characterized in that it comprises: shift registers comprising components corresponding to each of the recording elements; a switch that is switched, by an inputted connection signal, between a first connection state connected to the neighbor component and a second connection state connected to a non-drive data generator; and a switch control unit that outputs a connection signal on the basis of position data representing positions of the drive elements.

Because the printhead is arranged with the plural recording elements, it is desirable to reliably switch between driving and not driving the plural recording elements. Thus, the generation unit comprises the shift registers, the switch and the switch control unit, and the connection signal is outputted by the switch control unit on the basis of the position data representing positions of the drive elements. Due to this connection signal, the switch is switched to the first connection state that leads between the shift register components between the drive elements and is switched to the second connection state that connects the shift register components until the drive elements to the non-drive data generator. Thus, it is possible to reliably switch between driving and not driving the recording elements.

The second connection state connected to the non-drive data generator is grounded.

As described above, white data representing the color of the base of the recording medium is included in the non-drive data, and often a low-level state such as a ground level or a low level is generated to generate this white data. Thus, by grounding the second connection state connected to the non-drive data generator, it is possible to easily generate the non-drive data.

The selection unit is characterized in that it includes: a direction signal input unit for inputting a direction signal representing a main scanning orientation when the recording elements are relatively moved and main-scanned, with respect to a recording medium, in a direction intersecting an arranging direction of the recording elements; and a reciprocal selection unit that selects the blocks in a selection order of the blocks on the basis of the initial value when the main scanning orientation is a first direction and selects the blocks in a reverse order of the selection order when the main scanning orientation is a direction opposite to the first direction.

In a case where the printhead is used in a two-direction printer, when the recording elements are relatively moved and main-scanned, with respect to the recording medium, in two directions, i.e., in the directions intersecting the arranging direction of the recording elements, the main scanning direction becomes a direction that reverses back and forth. In this case, displacement of dots arises in the main scanning direction because the recording elements are driven in the same order of block selection back and forth. The reciprocal selection unit of the selection unit selects, from the direction signal representing the main scanning orientation inputted at the direction signal input unit, the blocks in the selection order of the blocks on the basis of the initial value when the main scanning orientation is the first direction. The reciprocal selection unit also selects the blocks in the reverse order of the selection order when the main scanning orientation is the direction opposite to the first direction. Thus, even in a case where the printhead is scanned in two directions, blocks in which dot displacement does not occur in the main scanning direction can be selected.

The reciprocal selection unit is characterized in that it includes: a forward direction order calculation unit that determines the selection order of the blocks on the basis of the initial value in the case of the first direction; a reverse direction order calculation unit that determines the reverse selection order of the blocks by adding to the initial value in the case of the opposite direction; and a direction switch that uses the direction signal to switch to the forward direction order calculation unit or the reverse direction order calculation unit.

In a case where the printhead is used as a two-direction printer, although this can be easily achieved by inputting the initial value defining the selection order in regard to each direction, the quantity of the initial value increases, which is not preferable. Thus, the reverse direction order calculation unit determines the reverse selection order of the blocks by adding to the initial value in the case of the opposite direction. Thus, even in a case where the printhead is scanned in two directions, blocks in which dot displacement does not occur in the main scanning direction can be selected with the same initial value.

The reciprocal selection unit is characterized in that it includes a counter that successively counts in accordance with a clock signal to which the initial value is inputted, and the forward direction order calculation unit or the reverse direction order calculation unit outputs an added value resulting from a +1 counter to the counter.

In this manner, by counting the added value resulting from the +1 counter, autonomous and periodic block selection resulting from the successive counting of the initial value in accordance with the inputted clock signal and counting in the opposite direction can be achieved with a simply configuration resulting from the counter.

By using the printhead to configure a recording device, it becomes possible to control position displacement of dots formed on the recording medium by the recording elements. Specifically, a recording device arranged with the printhead of the invention comprises: plural printheads in order to record an image on a recording medium, the plural printheads comprising a first printhead and a second printhead, wherein each of the first and second printheads includes plural recording elements that are divided into plural blocks and driven per divided block, an input unit for inputting an initial value of a selection order of the blocks in order to drive the recording elements, and a selection unit that selects, on the basis of the inputted initial value, the blocks for driving the recording elements according to the selection order of the blocks, with recording elements of a number that is less than the number of plural recording elements being set as drive elements, wherein a printhead group arranged with the first printhead and the second printhead is formed so that so that at least parts of relative positions in an arranging direction of the recording elements of the drive elements of the first printhead and the drive elements of the second printhead are overlapped; and a setting unit that sets a first initial value defining a selection order of the blocks corresponding to positions of the drive elements of the recording elements of the first printhead and sets a second initial value defining a selection order of the blocks corresponding to a displacement amount of positions of the drive elements of the recording elements of the second printhead with respect to positions of the drive elements of the recording elements of the first printhead.

By including, in a recording device arranged with plural printheads, a configuration where a first printhead, in which recording elements of a number that is less than the number of plural recording elements are set as drive elements, and a similar second printhead are combined with respect to the plural printheads, displacement of the recording elements in the subscanning direction of the first printhead and the second printhead can be eliminated. That is, each of the first printhead and the second printhead is arranged so that at least parts of relative positions in the arranging direction of the recording elements of the drive elements of the second printhead are overlapped with the drive elements of the first printhead as a printhead group. In this case, the setting unit sets the first initial value defining a selection order of the blocks corresponding to positions of the drive elements of the recording elements of the first printhead. Together with this, the setting unit sets a second initial value defining a selection order of the blocks corresponding to a displacement amount of positions of the drive elements of the recording elements of the second printhead with respect to positions of the drive elements of the recording elements of the first printhead. Thus, displacement in the main scanning direction that changes in accordance with the displacement amount of the second printhead from the first printhead, i.e., the displacement amount of the recording elements in the subscanning direction, can be eliminated by setting the second initial value.

When the printhead group is arranged so that parts of the relative positions in the arranging direction of the recording elements of the drive elements of the first printhead and the drive elements of the second printhead are overlapped, the number of the drive elements is set to an integral multiple of the number of blocks.

Sometimes the plural printheads are configured in a line to expand the print band formable by one printhead. In this case, there are cases where periodic fluctuation occurs at connection portions of the plural printheads. Thus, when the printhead group is arranged so that parts of the relative positions in the arranging direction of the recording elements with the drive elements of the first printhead and the drive elements of the second printhead are overlapped, the number of the drive elements is set to an integral multiple of the number of blocks. Thus, periodicity of the dots formed by each printhead is completed within each head, the plural printheads are in a relative relation of an integral multiple, and the relative relation can be maintained.

The printhead group may be characterized in that the first printhead and the second printhead are staggeringly arranged.

As described above, as a disposition suited for setting the number of drive elements to an integral multiple of the number of blocks, there is a printhead group in which the first printhead and the second printhead are staggeringly arranged.

The printhead group is characterized in that the arranging directions of the recording elements of each of the first printhead and the second printhead are reversed.

Oftentimes, printhead wiring for connection is necessary. This wiring is often arranged at one side of the printhead from the standpoint of wiring inside the printer and the like. Thus, by disposing the printhead group so that the arranging directions of the recording elements of each of the first printhead and the second printhead are reversed, it becomes possible to easily take out wiring from the printhead.

At least one printhead of the first printhead and the second printhead is characterized in that it includes plural recording element groups in the arranging direction of the recording elements.

By configuring the invention so that at least one printhead of the first printhead and the second printhead includes plural recording element groups in the arranging direction of the recording elements, the recording elements of the printhead can be increased.

The plural recording element groups of at least one printhead of the first printhead and the second printhead are characterized in that they include different recording element arranging directions.

By configuring the invention so that the plural recording element groups of at least one printhead of the first printhead and the second printhead include different recording element arranging directions, the recording elements of the printhead can be increased and wiring of the wiring and the like can be easily planned in regard to single printheads.

At least one printhead of the first printhead and the second printhead is characterized in that it includes recording elements in each of plural directions parallel to the arranging direction of the recording elements.

By configuring the invention so that at least one printhead of the first printhead and the second printhead includes recording elements in each of plural directions parallel to the arranging direction of the recording elements, the recording elements of the printhead can be increased and their relative relations can be easily grasped per recording element.

In this case, the plural recording element groups of the at least one printhead of the first printhead and the second printhead are characterized in that they include different recording element arranging directions.

In this manner, by configuring the invention so that the plural recording element groups of the at least one printhead of the first printhead and the second printhead include different recording element arranging directions, the recording elements of the printhead can be increased and their relative relations can be easily grasped per recording element.

The printheads are characterized in that they are recording medium-width recording printheads in which the recording elements are arranged so that they reach a length corresponding to the width of the recording medium.

By adopting, as the printheads, paper-width recording printheads in which the recording elements are arranged so that they reach a length corresponding to the width of the recording medium, large-scale recording can be implemented with high fineness.

The printheads are characterized in that they are inkjet recording printheads that record by ejecting ink.

The printheads are suitable to use as inkjet recording printheads that record by ejecting ink.

BRIEF DESCRIPTION OF THE DRAWINGS

FIG. 11 is an allocation chart showing corresponding relations between blocks and the print elements pertaining to the first embodiment;

FIG. 28 is an allocation chart for describing reallocation of connection relations of drive print elements in the fourth embodiment;

DETAILED DESCRIPTION OF THE INVENTION

An example of embodiments of the invention will be described in detail below with reference to the drawings.

Figure 2:
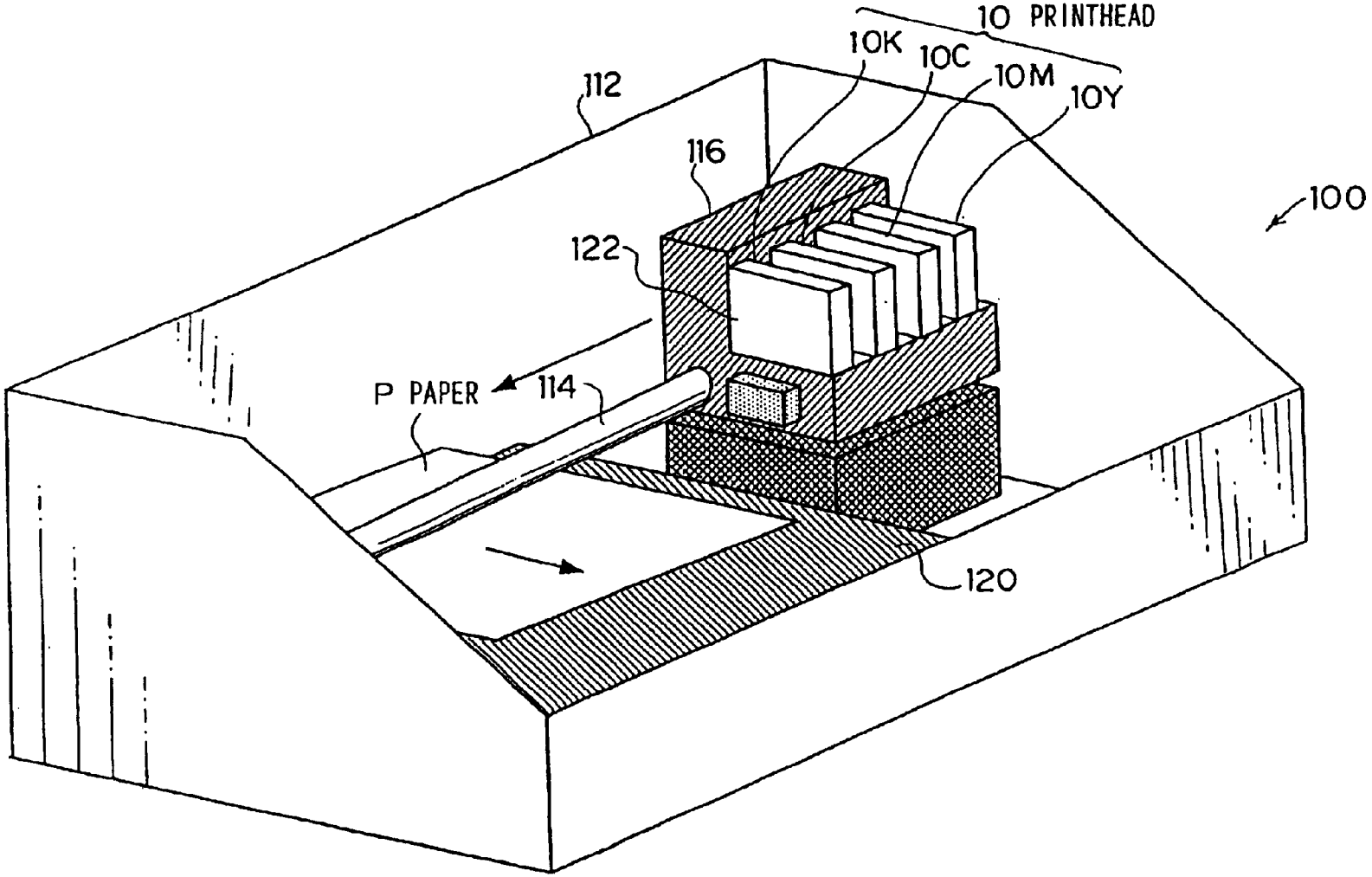
FIG. 2 is a perspective view showing one example of the configuration of a color printer to which the printhead of the invention is applicable.

As shown in FIG. 2, a color printer 100 pertaining to the embodiments of the invention includes a case 112 arranged with a rod 114 and a carriage 116 that moves along the rod 114. Color printheads 10 that record colors corresponding to the respective colors of CMYK (in FIG. 2, the K color is represented by printhead 10K, the C color is represented by printhead 10C, the M color is represented by printhead 10M, and the Y color is represented by printhead 10Y) are detachably mounted on the carriage 116. Recording in the main scanning direction is conducted by the carriage 116 moving along the rod 114 (in the main scanning direction shown in FIG. 3).

A platen 120 for mounting a paper P serving as a printing medium is arranged in the color printer 100. Recording in the subscanning direction is conducted by the paper P moving over the platen 120 in a direction (subscanning direction shown in FIG. 3) intersecting the main scanning direction of the carriage 116.

Figure 3:
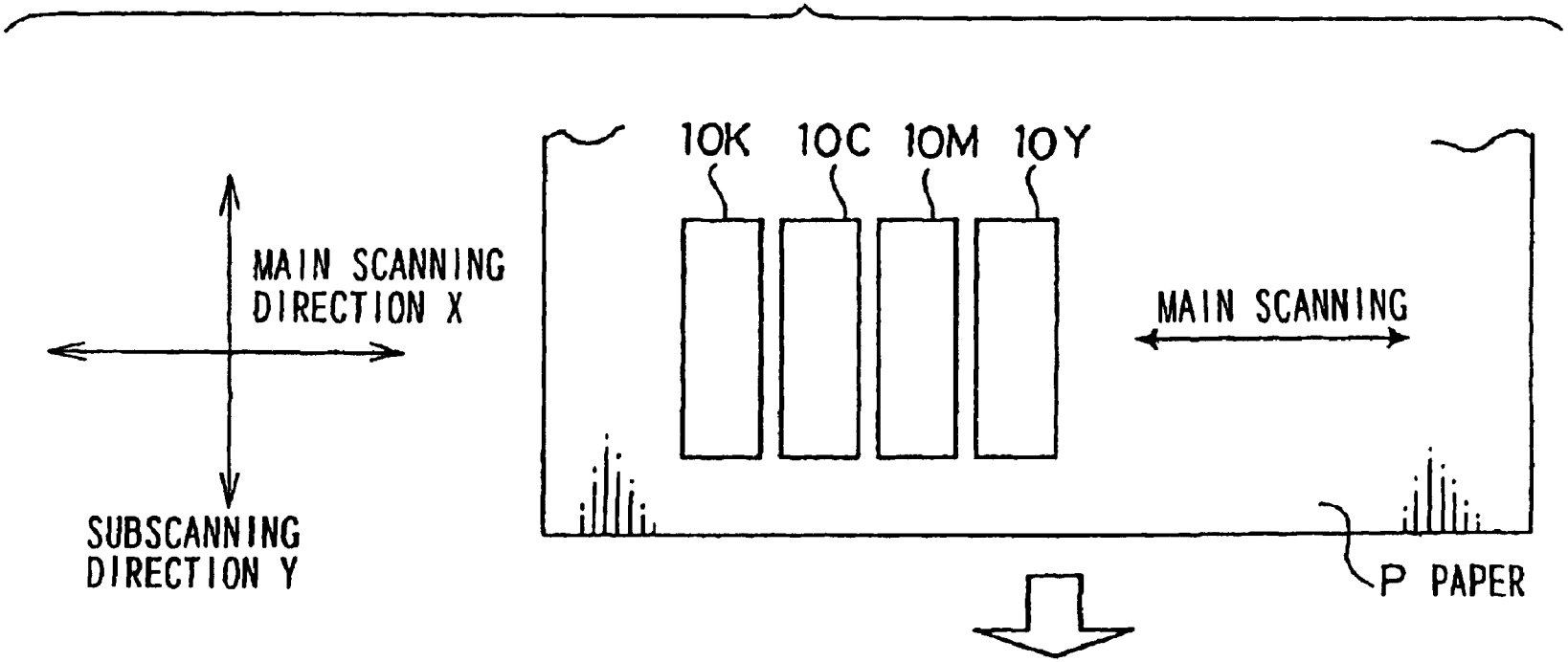
FIG. 3 is a conceptual diagram showing a main scanning direction and the positional relation of printheads in the color printer to which the printhead of the invention is applicable.

That is, an image is formed in the main scanning direction by ejecting ink of the respective colors of the printheads 10 mounted on the carriage 116 while scanning the carriage 116 in the main scanning direction along the rod 114. It should be noted that the image is formed in part of or all of a recording region formed on the paper P on the platen 120 at a nozzle row length (subscanning direction) of the printheads 10 and the scanning length of the carriage 116. The paper P is sent by an amount corresponding to the length at which the image is formed in the subscanning direction, image formation is again conducted in the main scanning direction, and image formation in the main scanning direction and sending of the paper in the subscanning direction are repeatedly conducted, whereby image formation is conducted on the entire surface of the paper P. Although the printheads 10 of the respective colors are configured so that they are arranged in the order of K, C, M and Y along the scanning direction of the carriage 116, as shown in FIGS. 2 and 3, they are not limited thereto.

Figure 4:
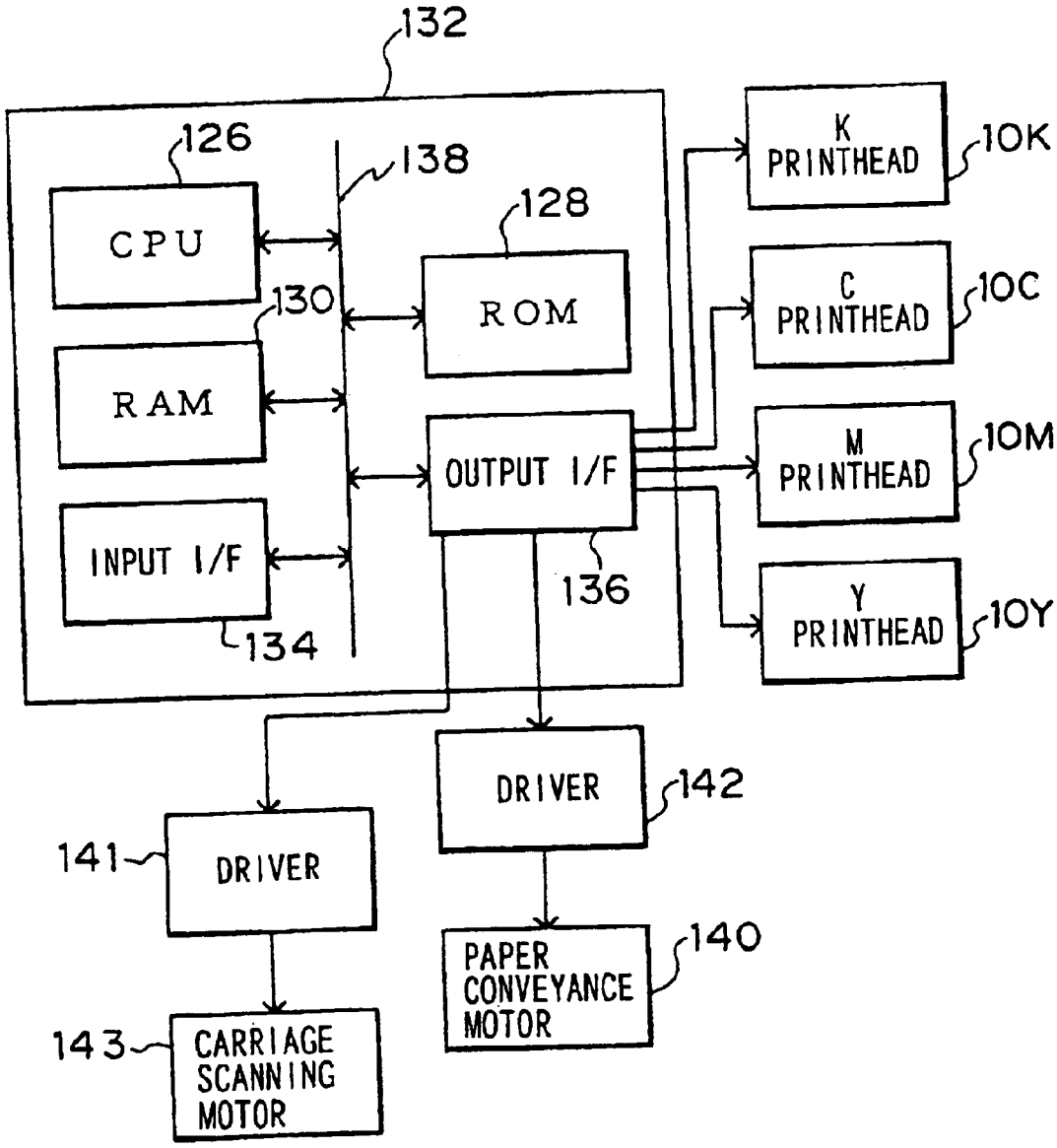
FIG. 4 is a conceptual block diagram showing connection relations of the color printer to which the printhead of the invention is applicable.

As shown in FIG. 4, control of the operation of the color printer 100 is conducted by a microcomputer 132 arranged with a CPU 126, a ROM 128, a RAM 130 and peripheral devices. The CPU 126, the ROM 128, the RAM 130, an input interface (input I/F) 134 and an output interface (output I/F) 136 of the microcomputer 132 are connected to a bus 138. Data and commands are inputted to the input I/F 134 from other devices.

A driver 142, which drives a conveyance motor 140 for conveying the paper P, and a driver 141, which drives a carriage scanning motor 143 for moving the carriage 116, are connected to the output I/F 136. The conveyance motor 140 and the carriage scanning motor 143 are controlled in accordance with an instruction from the microcomputer 132.

The various color printheads 10 (10K, 10C, 10M and 10Y) are connected to the output I/F 136. Discharge of ink from the various color printheads 10 is controlled by the microcomputer 132.

As for the control of the discharge of ink from the various color printheads 10, an image recording position with respect to the scanning direction of the carriage 116 can be controlled by, for example, controlling the timing at which the ink is discharged from plural nozzles for discharging ink arranged at the printheads 10. Although the details thereof will be described later, the plural nozzles for discharging ink of the printheads 10 are set and controlled as print elements where fewer print elements than the number of print elements mounted at the printheads 10 are actually used, whereby the image recording position with respect to the conveyance direction of the paper P can be controlled.

(First Embodiment)

Figure 5:
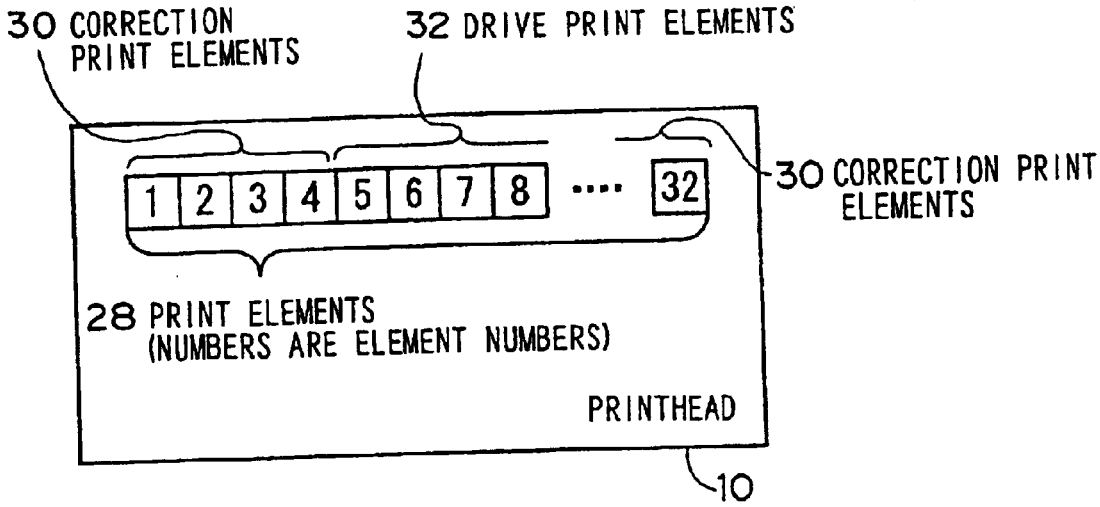
FIG. 5 is a structural diagram showing the disposition of print elements of the printhead to which the invention is applicable.

As shown in FIG. 5, thirty-two print elements 28 are arranged in one row in the printhead 10 pertaining to the present embodiment. Of these print elements 28, the elements that are actually used are grouped into eight blocks (details described later). The numbers of print elements and blocks are an example and not limited thereto. It should be noted that, in the present embodiment, although a case will be described where the print elements 28 are arranged in one row, the invention can also be enlarged to a case where the print elements are arranged in plural rows. As for allocation of element numbers of the print elements 28, sequential numbers are allocated in the row direction of the print elements 28. In the example of FIG. 5, the left end is allocated as element number "1".

The print elements 28 are allocated as drive print elements and correction print elements. In the present embodiment, of the thirty-two print elements 28, eight print elements 28 are allocated as correction print elements 30 and twenty-four print elements 28 are allocated as drive print elements 32. The standard allocation of these correction print elements 30 and drive print elements 32 adopts an allocation where four of the eight correction print elements 30 are each arranged at both sides of the twenty-four drive print elements 32. That is, the print elements 28 of element numbers "5" to "28" are allocated as the drive print elements 32 and the print elements 28 of element numbers "1" to "4" and "29" to "32" are allocated as the correction print elements 30. Thus, it corresponds to subscanning registration correction of ±four elements.

Figure 6:
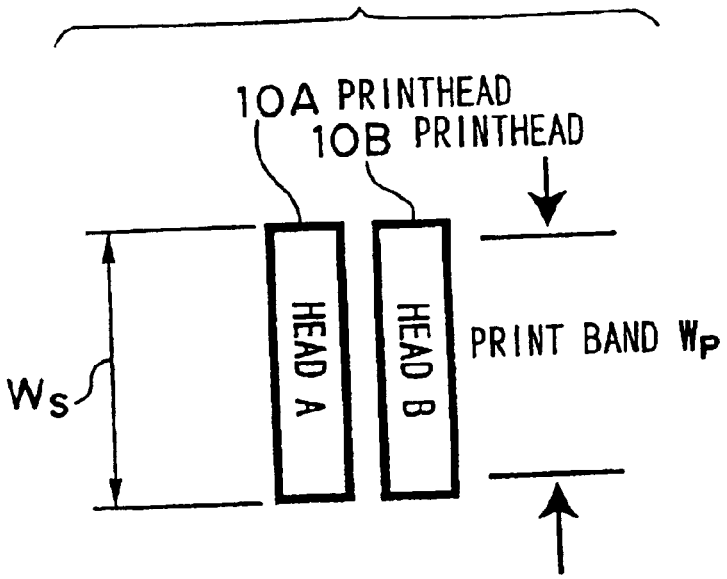
FIG. 6 is a conceptual diagram showing the positional relation of plural printheads pertaining to the first embodiment.

In the printer pertaining to the present embodiment, plural (four) printheads 10 are arranged. Here, in order to simplify description of their relative relation, as shown in FIG. 6, two printheads 10, in which a printhead 10 of any one color (any one of the printheads 10K, 10C, 10M and 10Y of FIG. 2) is designated as printhead 10A and a printhead 10 of another color is designated as printhead 10B, will be described.

The printhead 10A and the printhead 10B are arranged so that the arranging directions of the print elements 28 are substantially parallel and so that their relative positional relations are substantially the same. A print band $W_P$ having print elements 28 in common between the printheads 10A and 10B is set with respect to an element band $W_S$ that is the arrangement width of the print elements 28. Thus, by using print element groups of a fixed number that is less than the number of print elements mounted at the printheads 10 ($W_S>W_P$), subscanning registration correction can be conducted.

Figure 1:
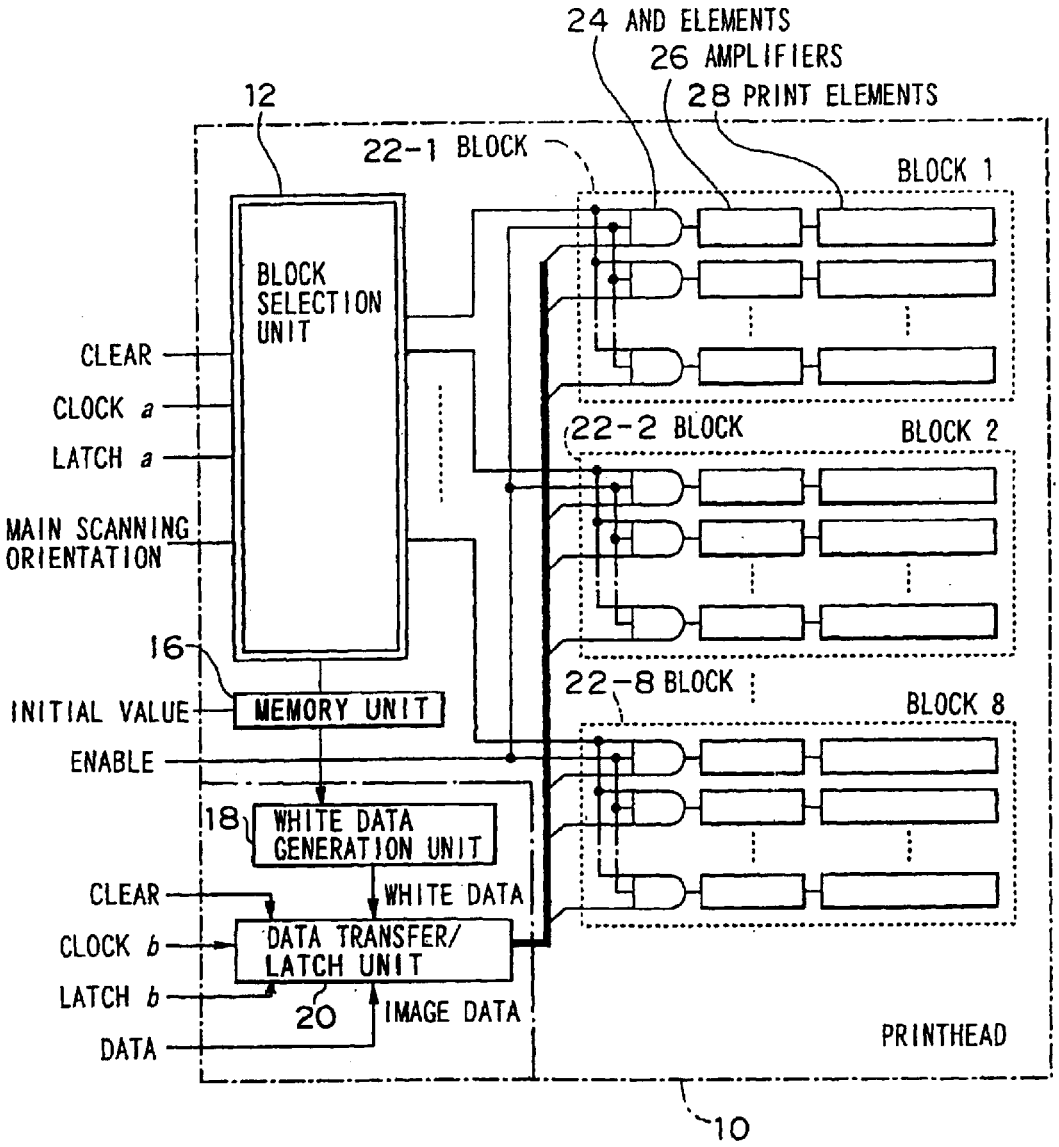
FIG. 1 is a block diagram showing the schematic configuration of a printhead vicinity pertaining to a first embodiment of the invention.

In FIG. 1, a conceptual block diagram of the printhead pertaining to the present embodiment is shown. The printhead 10 includes a block selection unit 12. An output side of the block selection unit 12 is connected to eight blocks 22-1 to 22-8 in which the thirty-two print elements 28 are grouped and included. The block selection unit 12 generates and outputs a selection signal for selecting any of the eight blocks 22-1 to 22-8.

An input side of the block selection unit 12 is configured so that a clear signal, a clock a signal, a latch a signal and a direction signal representing the main scanning orientation are inputted thereto. Another input side of the block selection unit 12 is configured so that an initial value for selecting any of the eight blocks 22-1 to 22-8 is inputted thereto via a memory unit 16.

It should be noted that the memory unit 16 of the present embodiment corresponds to a memory unit of the invention and that the other input side of the block selection unit 12 corresponds to an input unit of the invention. Also, the block selection unit 12 corresponds to a selection unit of the invention and the print elements 28 correspond to recording elements of the invention.

An input side of the memory unit 16 is connected so that the initial value is inputted thereto from the microcomputer 132, and an output side of the memory unit 16 is connected to the block selection unit 12. The output side of the memory unit 16 is also connected to a white data generation unit 18 arranged outside the printhead 10. An output side of the white data generation unit 18 is connected to one input side of a data transfer/memory unit 20.

The input side of the data transfer/memory unit 20 is configured so that a clear signal, a clock b signal, a latch b signal and an image signal representing image data are inputted thereto. An output side of the data transfer/memory unit 20 is configured so as to be commonly connected to each of the eight blocks 22-1 to 22-8 within the printhead 10.

The white data generation unit 18 generates so-called "white data" that does not drive the correction print elements 30. The data transfer/memory unit 20 is for supplying, to the printhead (i.e., each block 22), data of the mounted print elements in which data from the white data generation unit 18 and image data for the drive print elements 32 are synthesized.

It should be noted that the white data generation unit 18 and the data transfer/memory unit 20 can be arranged at the output I/F 136.

The block 22-1 is arranged, for the number of print elements 28 included within that block, with circuits resulting from a combination of an AND element 24 that has three inputs and one output, an amplifier 26 and the print element 28. In each circuit, the output side of the AND element 24 is connected to the print element 28 via the amplifier 26. The block selection unit 12 is connected to the first input sides of the AND elements 24 and connected to the second input sides of the AND elements 24 so that enable signals are inputted thereto. The data transfer/memory unit 20 is connected to the third input sides of the AND elements 24.

It should be noted that description of the blocks 22-2 to 22-8 will be omitted because they have the same configuration as that of the block 22-1.

Figure 7:
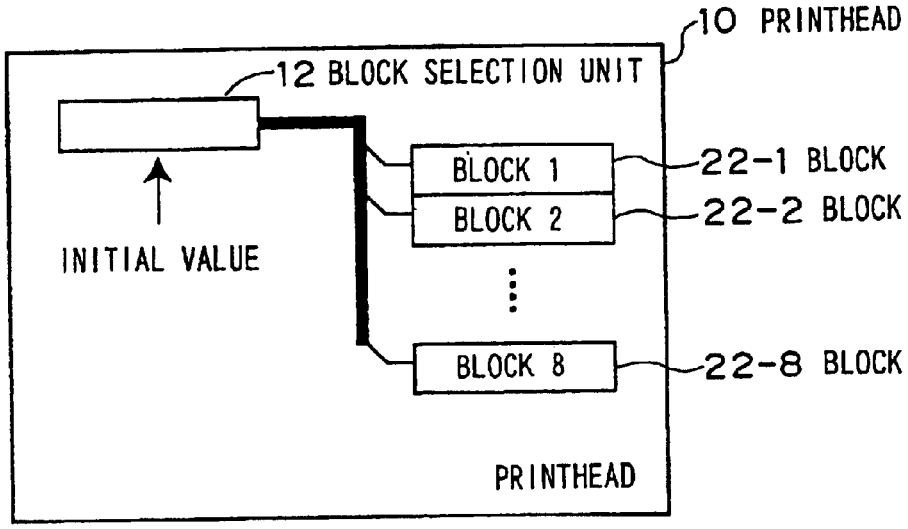
FIG. 7 is an explanatory diagram for describing a block selection unit pertaining to the first embodiment.

The block selection unit 12 is a key configuration for main scanning registration correction in the present embodiment. As shown in FIG. 7, the block selection unit 12 autonomously and periodically continues a selection operation of the blocks on the basis of the inputted variable initial value. This selection operation is continuously implemented as long as a stop signal is not inputted from the outside. This will be described in detail below.

Figure 8:
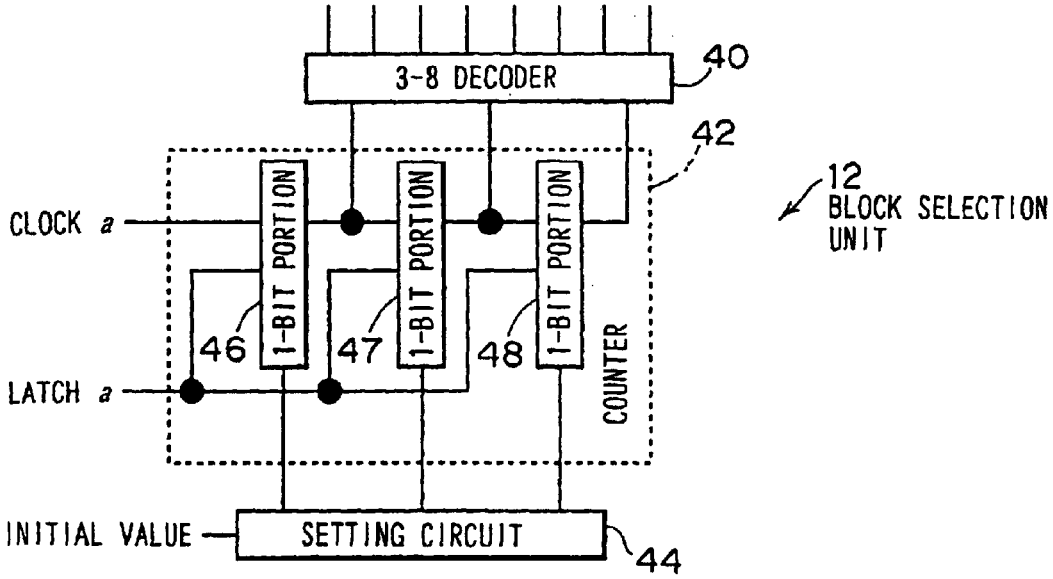
FIG. 8 is a block diagram showing one example of the configuration of the block selection unit pertaining to the first embodiment.

As shown in FIG. 8, the block selection unit 12 comprises a decoder 40, a ring counter 42 that includes a latch function, and a setting circuit 44 that functions as a serial parallel conversion circuit.

It should be noted that the decoder 40 and the ring counter 42 correspond to a repeat selection unit of the invention.

The initial value of a 3-bit serial format is inputted to the setting circuit 44, and output sides of the setting circuit 44 are connected to input sides of the ring counter 42. In the setting circuit 44, 3-bit serial data inputted as the initial value is parallel-converted and the parallel data is outputted to the ring counter 42.

Thus, the 3-bit serial data inputted as the initial value in the 3-bit serial format is parallel-converted in the setting circuit 44 and the parallel data is outputted to the ring counter 42.

The ring counter 42 is arranged with counter circuits 46, 47 and 48 corresponding to each of the inputted parallel data. The ring counter 42 is connected so that the latch a signal is commonly inputted to each of the counter circuits 46 to 48, the clock a signal is inputted to the counter circuit 46, the output of the first counter circuit 46 is inputted to the second counter circuit 47, and the output of the second counter circuit 47 is inputted to the third counter circuit 48. Output sides of each of the counter circuits 46, 47 and 48 are connected to input sides of the decoder 40.

It should be noted that, because it is safe to think of the main scanning registration amount and the subscanning registration amount as fixed values during ordinary driving of the printer, it is preferable to arrange a latch function in the setting circuit 44 and to keep the prior initial value until an initial value is inputted again.

Figure 9:
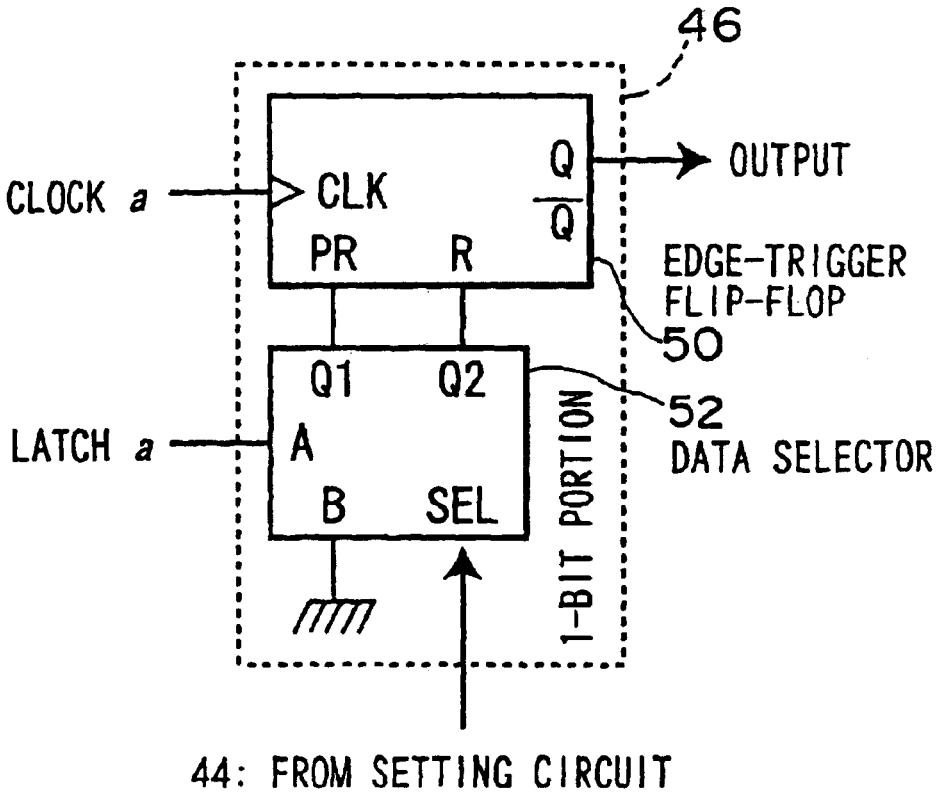
FIG. 9 is a block diagram showing one example of the configuration of a counter circuit included in a ring counter of the block selection unit pertaining to the first embodiment.

As shown in FIG. 9, the counter circuit 46 comprises an edge-trigger flip-flop element 50 and a data selector element 52. The counter circuit 46 is connected so that the latch a signal is inputted to an input terminal A of the data selector element 52, and an input terminal B is arranged. An SEL terminal of the data selector element 52 is connected to the setting circuit 44, an output terminal Q1 is connected to a preset terminal PR of the flip-flop element 50, and an output terminal Q2 of the data selector element 52 is connected to a reset terminal R of the flip-flop element 50. The counter circuit 46 is also connected so that the clock a signal is inputted to a CLK terminal of the flip-flop element 50, and an output terminal Q of the flip-flop element 50 is connected to the decoder 40.

In the data selector element 52, either of the input terminals A and B is connected to either of the output terminals Q1 and Q2 in accordance with an initial value of 1-bit. The other of the two inputs is grounded so as to always be at a low level. The latch inputted to the input terminal A is outputted to the output terminal Q2 when the initial value is of a low level and outputted to the output terminal Q1 when the initial value is of a high level.

The flip-flop element 50 is set in advance to either a preset state or a reset state prior to the clock input. When the initial value has moved to a low level, the flip-flop element 50 is reset and the output becomes a low level. Conversely, when the initial value has moved to a high level, the flip-flop element 50 is preset and the output becomes a high level. Thus, the initial value inputted from the setting circuit 44 becomes the initial value of the counter output of the ring counter 42.

It should be noted that, because the counter circuits 47 and 48 have the same configuration as that of the counter circuit 46, detailed description thereof will be omitted. However, the output terminal Q of the counter circuit 46 is connected to the CLK terminal arranged in the flip-flop element 50 of the counter circuit 47, and the output terminal Q of the counter circuit 47 is connected to the CLK terminal arranged in the flip-flop element 50 of the counter circuit 48.

Thus, in the setting circuit 44, the inputted 3-bit initial value becomes the initial value of the counter output, and thereafter a count-up operation is conducted in accordance with the clock input.

It should be noted that the clock signal may be a dedicated signal or a signal where the enable signals of the print elements 28 are synthesized for all of the blocks. The latter is preferable in order to reduce the number of input pads. In the present embodiment, a signal that is generated by synthesizing the enable signals of the print elements 28 for all of the blocks is used as the clock signal.

Figure 10:
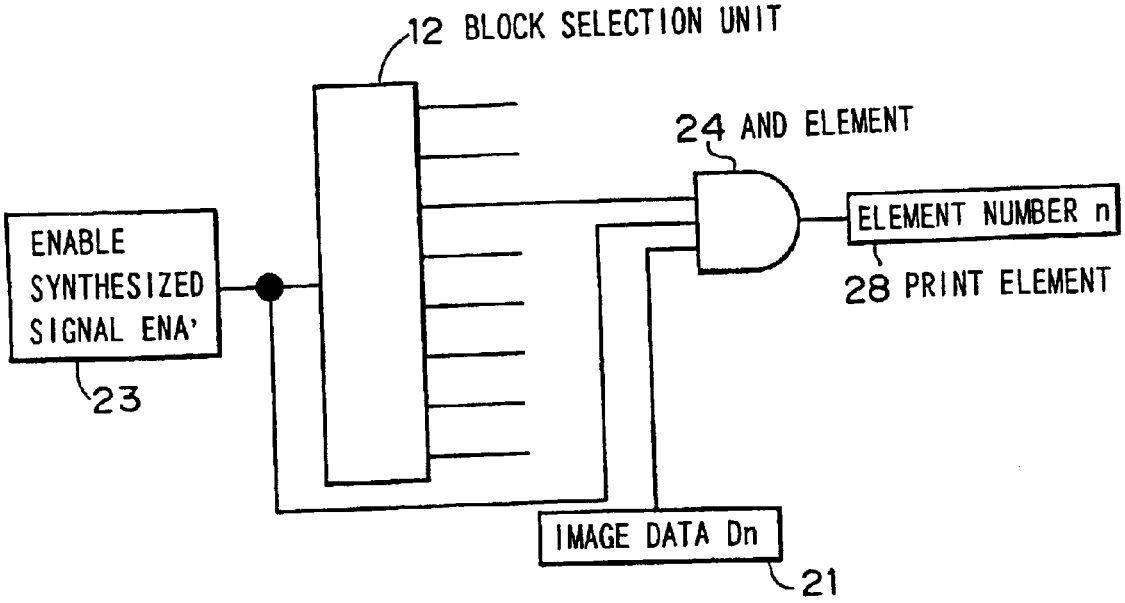
FIG. 10 is a block diagram showing one example of the configuration of a print element vicinity pertaining to the first embodiment.

As shown in FIG. 10, in the present embodiment, the AND element 24 is arranged at the input side of the print element 28. It should be noted that the amplifier 26 is omitted from FIG. 10. The inputs of the AND element 24 is respectively connected to one predetermined output of the block selection unit 12, a synthesizing unit 23 that outputs an enable synthesized signal ENA integrated with the clock a signal inputted to the block selection unit 12, and an image data output unit 21 that outputs image data Dn. That is, in the present embodiment, the clock a signal and the enable signal are used equivalently. The same is true of the other print elements 28.

Because the enable synthesized signals ENA of all of the blocks are used in this manner as the clock a signal, an enable synthesized signal ENA of a predetermined timing is extracted by an AND operation of at least the clock a signal and the block selection output signal of the block selection unit 12. Moreover, the print element 28 of element number "n" is driven in accordance with the image data Dn.

It should be noted that the synthesizing unit 23 corresponds to a synthesizing unit of the invention and that the AND element 24 corresponds to a product calculation unit of the invention.

Next, main scanning registration correction between the printheads in the present embodiment will be described.

As shown in FIG. 11, in the present embodiment, each print element 28 adopts, as a standard, a case where equal element numbers of a remainder with respect to the number of blocks are allocated to the same block. As described above, because the number of blocks is eight, the remainder of 8 is 1 for each of element numbers "1" "9", "17" and "25", and these elements are allocated to the first block 22-1. The same is true for the second block 22-2 through the eighth block 22-8.

The number of drive print elements 32 is twenty-four, which is less than the thirty-two mounted print elements and equal to three times the number of eight blocks. That is, the number of drive print elements belonging to each block is equally allocated to be three. It should be noted that element numbers "1" to "4" and "29" to "32" are the correction print elements 30.

Incidentally, in inkjet printers, because fluid motion of ink exerts an influence on drive print element vicinities, interlace driving is preferable for the driving. Thus, in the present embodiment, description will be given using, as a standard, a case where an inkjet printer is adopted as the color printer 100.

Figure 12:
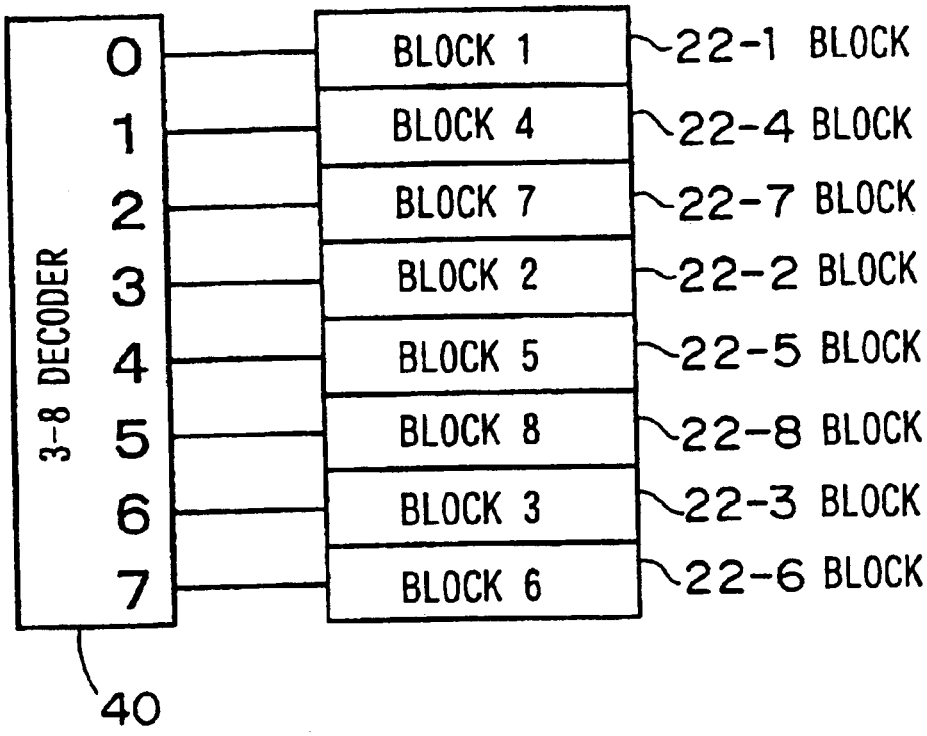
FIG. 12 is a connection diagram showing corresponding relations between the blocks and a decoder in the block selection unit pertaining to the first embodiment.

As shown in FIG. 12, the connection relations between the decoder 40 included in the block selection unit 12 and the blocks 22 are such that the bocks are connected in the order of block 22-1, block 22-4, block 22-7, block 22-2, block 22-5, block 22-8, block 22-3 and block 22-6, so that the blocks are driven every other three from one end of the drive print elements 32.

According to the block allocation of the print elements 28, the blocks are selected in order so that the end of the drive print elements—here, the fifth block 22-5—is selected for the standard of the initial value and initially driven, and then the next block—here, the eighth block 22-8—is driven thereafter. That is, in the main scanning direction, the print elements are driven in the order of the fifth, eighth, third, sixth, first, fourth, seventh and second blocks.

Figure 13:
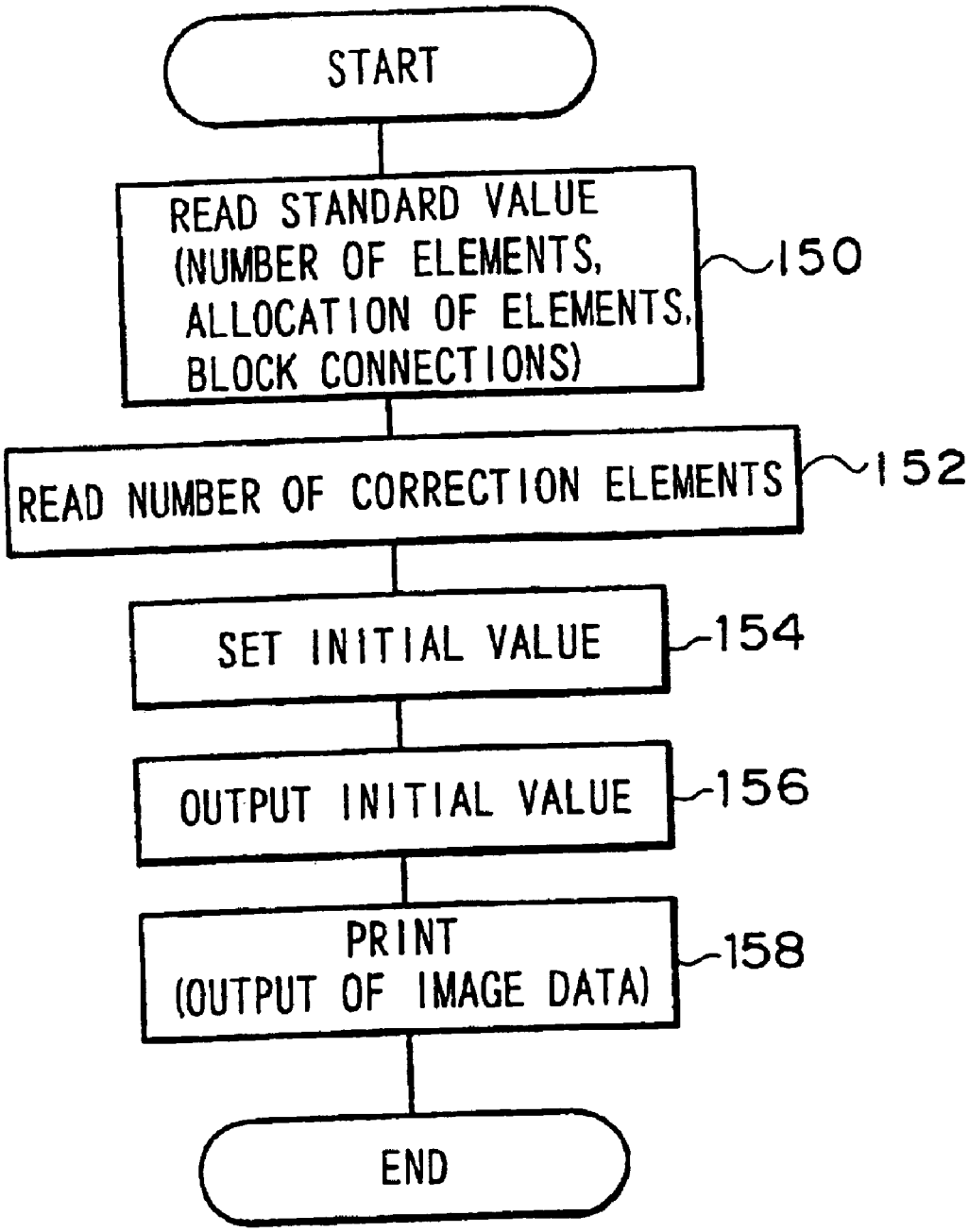
FIG. 13 is a flow chart showing the flow of processing implemented in the color printer to which the printhead of the invention is applicable.

On the basis of the standard, the processing routine of FIG. 13 is implemented in the microcomputer 132 per printhead 10. First, in step 150, the standard value is read.

This standard value is a standard value for adjusting the respective mutual relations of the printheads 10 mounted in the color printer 100, i.e., for subscanning registration correction and main scanning registration correction. In this standard value, there are the number of print elements 28 mounted in each printhead 10 (thirty-two in the present embodiment), the relations between the print elements 28 and the blocks (e.g., FIG. 11), and the connection relations (e.g., FIG. 12) between the blocks 22 and the block selection unit 12 (more specifically, the decoder 40). This standard value is stored in advance.

In step 152, the number of print elements 28 for subscanning registration correction of the printhead 10 is read. It should be noted that the number of correction elements may be the number of correction elements from the positional relation of the drive print elements 32 determined by the standard value. Also, a standard printhead 10 may be set from among the plural printheads 10 and the number of correction elements may be the number of correction elements from the standard printhead 10.

In step 154, the initial value defining the order of block selection driving the block selection unit 12 is set and, in step 156, the initial value is outputted to the printhead 10. This initial value is for changing the order of block selection for main scanning registration correction in correspondence with the number of correction elements (i.e., subscanning registration correction).

It should be noted that the processing of step 154 corresponds to a function of a setting unit of the invention and that setting different initial values with respect to each of the printheads 10 corresponds to setting a first initial value and a second initial value.

In step 158, image data and the like for printing is outputted. Thus, in the printheads 10, the print elements 28 are driven on the basis of the initial value.

Further description will be given here of main scanning registration correction between the printheads resulting from the initial value. Here, in order to simplify description of their relative relation, as shown in FIG. 6, two printheads 10, in which a printhead 10 of any one color (any one of the printheads 10K, 10C, 10M and 10Y of FIG. 2) is designated as printhead 10A and a printhead 10 of another color is designated as printhead 10B, will be described.

Figure 14:
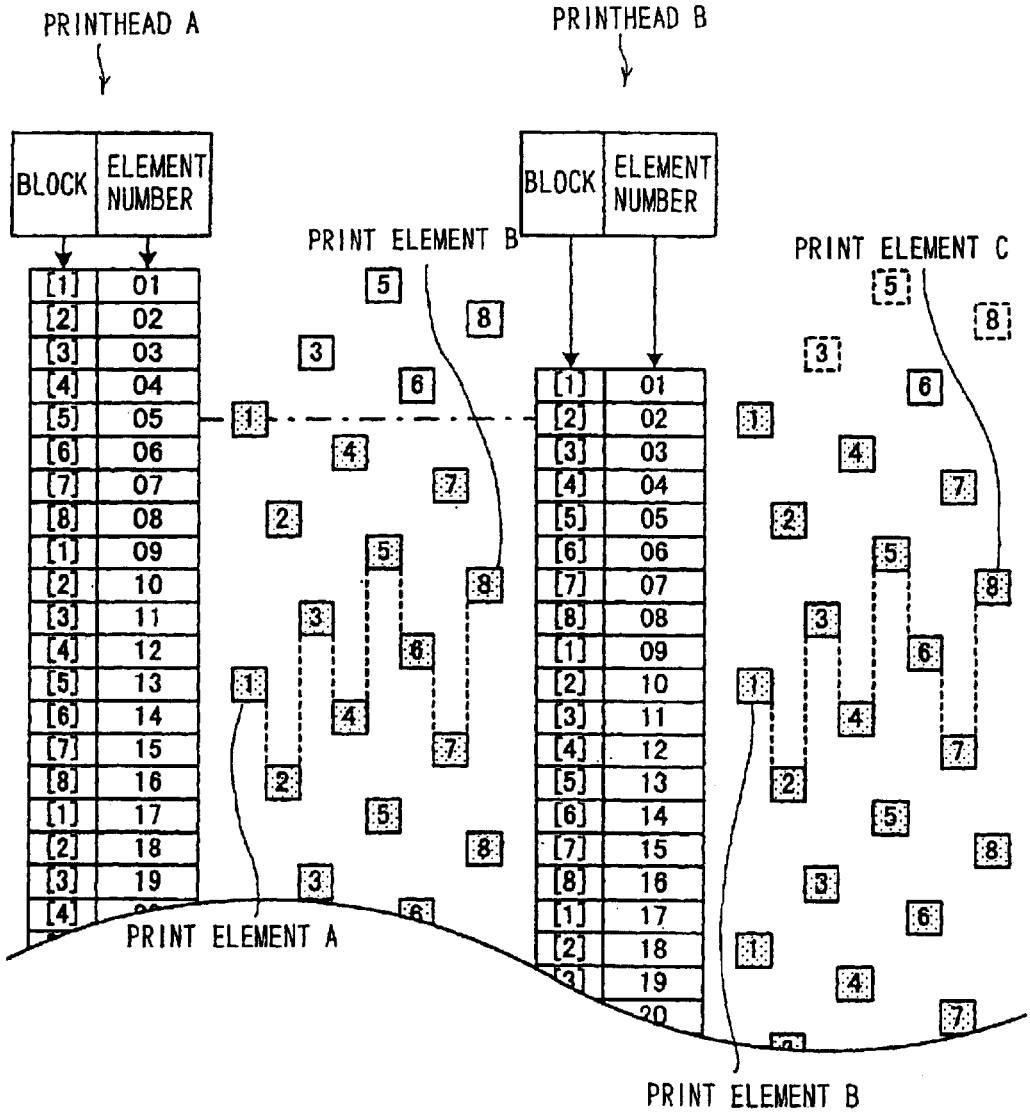
FIG. 14 is an explanatory diagram of main scanning registration correction resulting from the plural printheads in the first embodiment.

Description will be given of a case where, as shown in FIG. 14, the printhead A has a configuration that is consistent with the aforementioned standard and the printhead B is configured with a relative relation of a position displaced by three elements from the printhead A. That is, in this relation (see FIGS. 11 and 12), the printhead A plots from a print element A (e.g., element number "13") belonging to the initially selected block (the fifth block 22-5) to a print element B (e.g., element number "10") belonging to the finally selected block (the second block 22-2). At this time, description will be given of a case where the printhead B conducts subscanning registration correction in order to plot with the print element B (e.g., element number "10") belonging to the block (the second block 22-2) that is usually finally selected.

Because the relation between print elements is displaced by subscanning registration correction, when the blocks 22 are selected in the same selection order as printhead A, the print element B of the printhead B is finally selected and a time difference of eight blocks results in displacement in the main scanning direction. Thus, in the present embodiment, the initial value that selects the blocks 22 is variably set. In other words, the initial value changes.

Specifically, in this case, as shown in FIG. 14, the initial value is set so that the print elements of the printhead B are driven in the order of the second, fifth, eighth, third, sixth, first, fourth and seventh blocks (the setting of step 154). In this manner, even when the print elements plotting the same line change in accordance with the subscanning registration amount, main scanning registration correction becomes possible by changing the initial value.

Figure 15:
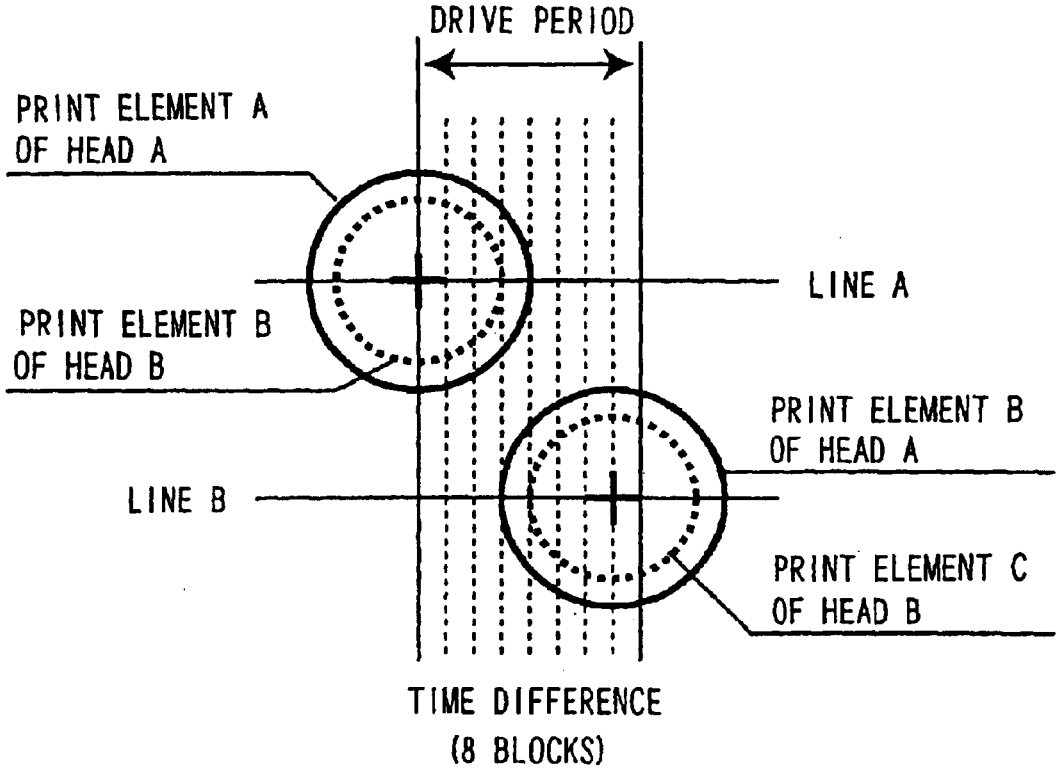
FIG. 15 is an explanatory diagram directed to dots in regard to main scanning registration correction resulting from the plural printheads in the first embodiment.

That is, as shown in FIG. 15, with respect to the printhead A, the print element A belonging to the initially selected block plots a dot at the position represented by the solid circle on line A on the paper P in accordance with the predetermined initial value, and the print element B belonging to the finally selected block similarly plots a dot at the position represented by the solid circle on line B.

However, in the printhead B, when the print element plotting the dot on line A is changed to the print element B and the print element plotting the dot on line B is changed to the print element C due to subscanning registration correction, it becomes possible to change the block selection order so that the block to which the print element B belongs is initially selected by using an initial value that is different from that of the printhead A. Thus, the position of the dot plotted on line A becomes the position represented by the broken circle and becomes the same as that of the printhead A. According to the change in the initial value, the print element C belonging to the finally selected block similarly plots a dot at the same position. It should be noted that, although the sizes of the circles in FIG. 15 have been changed to facilitate understanding, the dot radii are substantially the same for both the printhead A and the printhead B.

In this manner, even if print elements plotting the same line have changed in accordance with the subscanning registration amount, control can be achieved by using an appropriate initial value so that there is no displacement between the solid circle and the broken circle.

Inkjet-type print elements that discharge liquid ink drops from ink discharge ports due to the driving of heater elements or piezoelectric elements can be adopted for the print elements 28. As another example, there are heater elements such as thermal heads that supply thermal energy to a recording medium.

(Second Embodiment)

In the first embodiment, corresponding units to ensure that the correction print elements 30 are not driven, i.e., the white data generation unit 18 and the data transfer/memory unit 20, were mounted outside the printheads 10. Incidentally, in printers arranged with paper-width printheads, it is necessary to drive an enormous number of print elements at a high speed. Thus, in the present embodiment, a function of generating the "white data" is arranged in the printheads in order to reduce the burden of external controllers.

It should be noted that, because the present embodiment has the same configuration as that of the first embodiment, the same reference numerals will be given to the same portions and detailed description thereof will be omitted.

Figure 16:
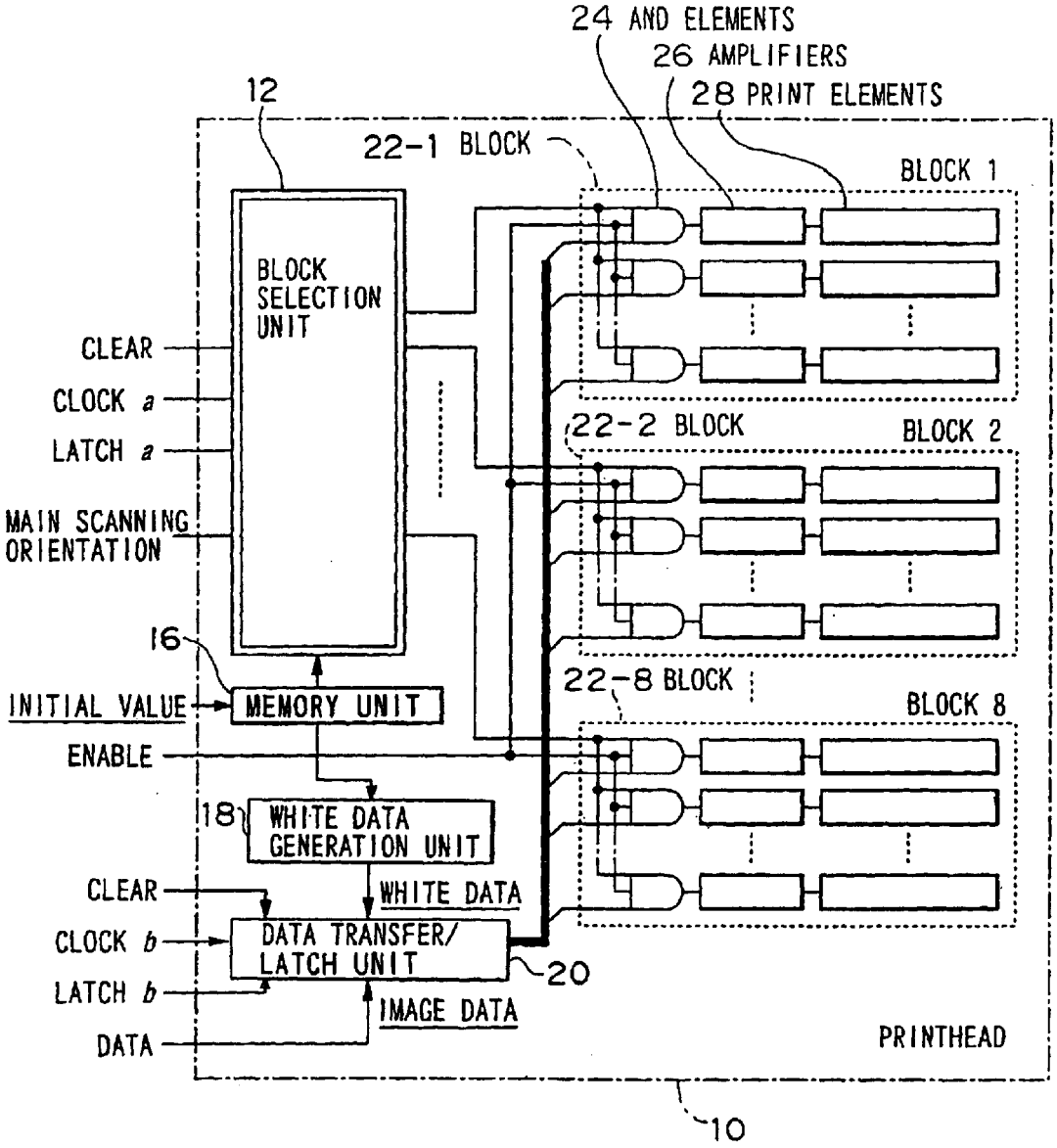
FIG. 16 is a block diagram showing the schematic configuration of a printhead vicinity pertaining to a second embodiment of the invention.

As shown in FIG. 16, the printhead 10 pertaining to the present embodiment is arranged with the white data generation unit 18 and the data transfer/memory unit 20. This is to reduce the load of external controllers and drive the print elements at a high speed. The remaining configuration is the same as the printhead 10 of FIG. 1.

Figure 17:
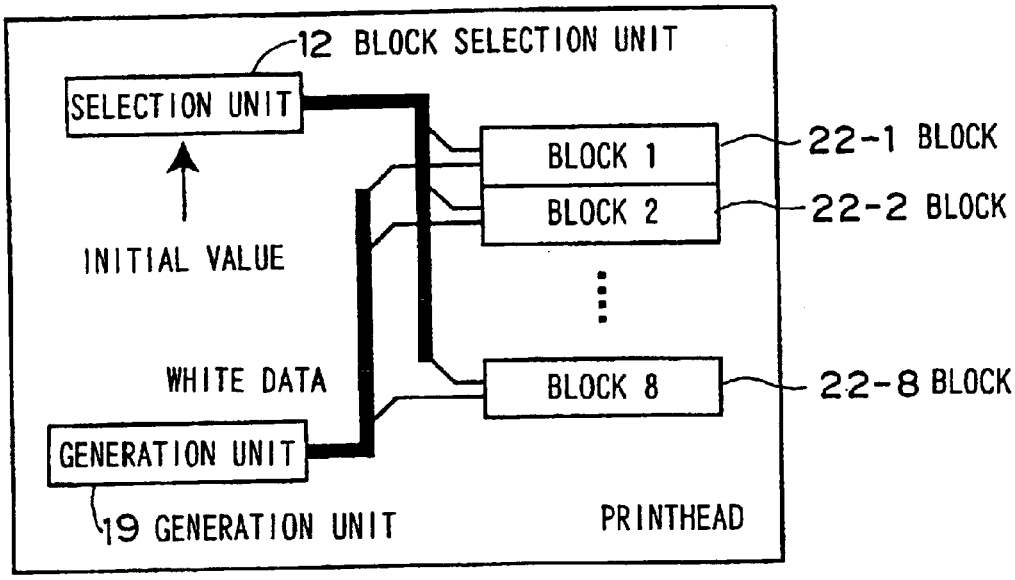
FIG. 17 is an explanatory diagram for describing a block selection unit pertaining to the second embodiment.

That is, in the present embodiment, as shown in FIG. 17, the key configuration for main scanning registration correction comprises the block selection unit 12, whose initial value is variable, and a generation unit 19 (the white data generation unit 18 and the data transfer/memory unit 20) of so-called "white data" that does not drive the correction print elements.

Because only data corresponding to the drive print elements 32 is inputted when the generation unit 19 of the white data is arranged in the printhead 10, a configuration in which the white data and image data are insulated and separated at boundaries between the drive print elements 32 and the correction print elements 30 is necessary.

Figure 18:
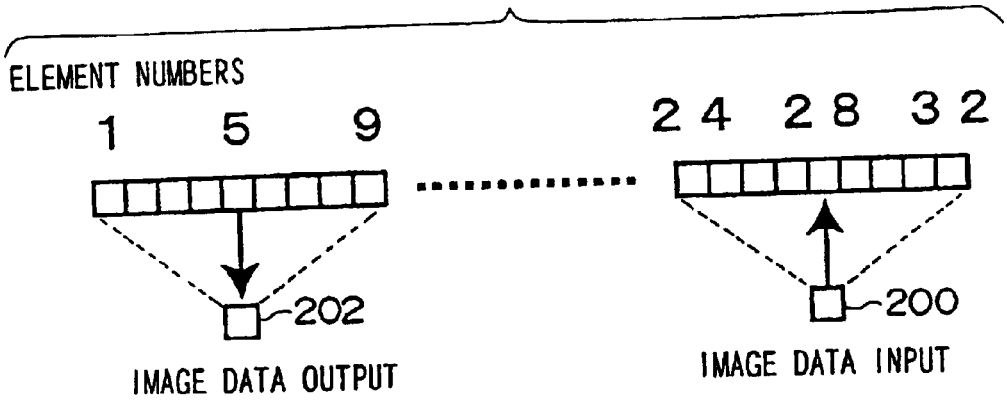
FIG. 18 is an explanatory diagram for describing the operation of a generation unit pertaining to the second embodiment.

Thus, in the present embodiment, according to the block allocation (e.g., see FIG. 11) of the print elements 28, as shown in FIG. 18, a data input terminal 200 is connected using, as one end, any one print element 28 of the drive print elements 32 present among element numbers "24" to "32" and a data output terminal 202 is connected using, as another end, any one print element 28 of the drive print elements 32 present among element numbers "1" to "9". Here, the key configuration for main scanning registration correction functions properly even if the data output terminal is not present.

Below, the generation unit 19 will be described in detail. It should be noted that, in the present embodiment, a case will be described where the element number "28" is connected to the data input terminal and the element number "5" is connected to the data output terminal.

Figure 19:
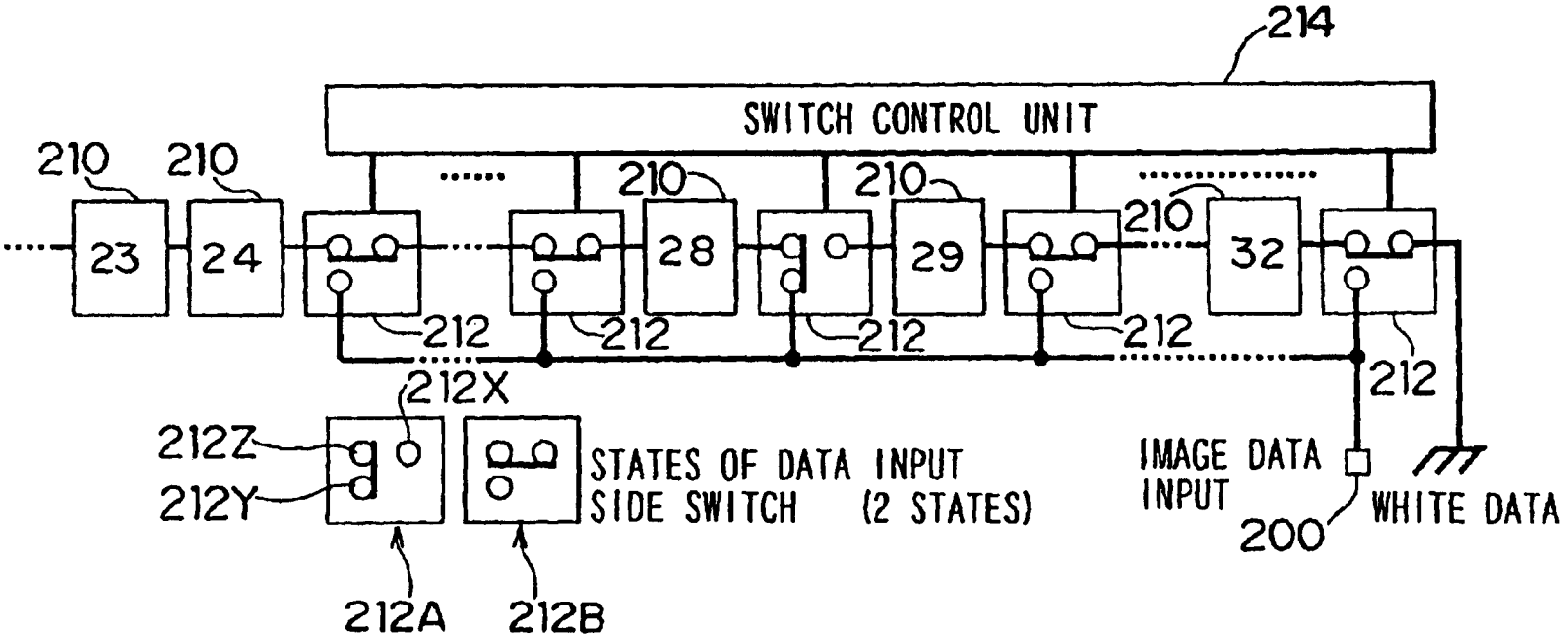
FIG. 19 is a conceptual diagram showing one example of the configuration of a data input side of the generation unit pertaining to the second embodiment.

As shown in FIG. 19, a data input side of the generation unit 19 comprises shift registers 210 corresponding to each of the print elements 28, a total of nine switches 212 inserted between each of the shift register 210 components, and a switch control unit 214. In FIG. 19, the element numbers of the print elements 28 are written within each of the shift register 210 components (shown by rectangles).

Each switch 212 is arranged with two input terminals and one output terminal, and is arranged at an input side of each shift register 210 component. Input terminals 212×of the switches 212 are connected to the output sides of the shift register components and other input terminals 212Y of the switches 212 are connected to the data input terminal 200. Output terminals X of the switches 212 are connected to the input sides of the shift register components. Also, control sides of the switches 212 are connected to the switch control unit 214. The switches 212 have a configuration that is switched by a control signal from the switch control unit 214 to one of a connection state 212A that leads through an output terminal 212Z and the input terminal 212Y and a connection state 212B that leads through the output terminal 212Z and the input terminal 212X.

The input terminal 212X of the switch 212 positioned at the end of the print elements 28 mounted at the printhead 10, i.e., positioned at the input side of the shift register component corresponding to the print element 28 of the element number "32", is grounded. Here, the "white data" is defined at a low level.

The switch control unit 214 operates to set the switches 212 to one of the connection states 212A or 212B in accordance with the 3-bit initial value (initial value inputted from the memory unit 16) and insulate and separate the data at the boundaries between the drive print elements 32 and the correction print elements 30 (here, between element number "28" and element number "29").

Next, a data output side of the generation unit 19 will be described. It should be noted that the configuration of the data output side of the generation unit 19 is the same as the configuration of the data input side except for the internal configuration of the switches.

Figure 20:
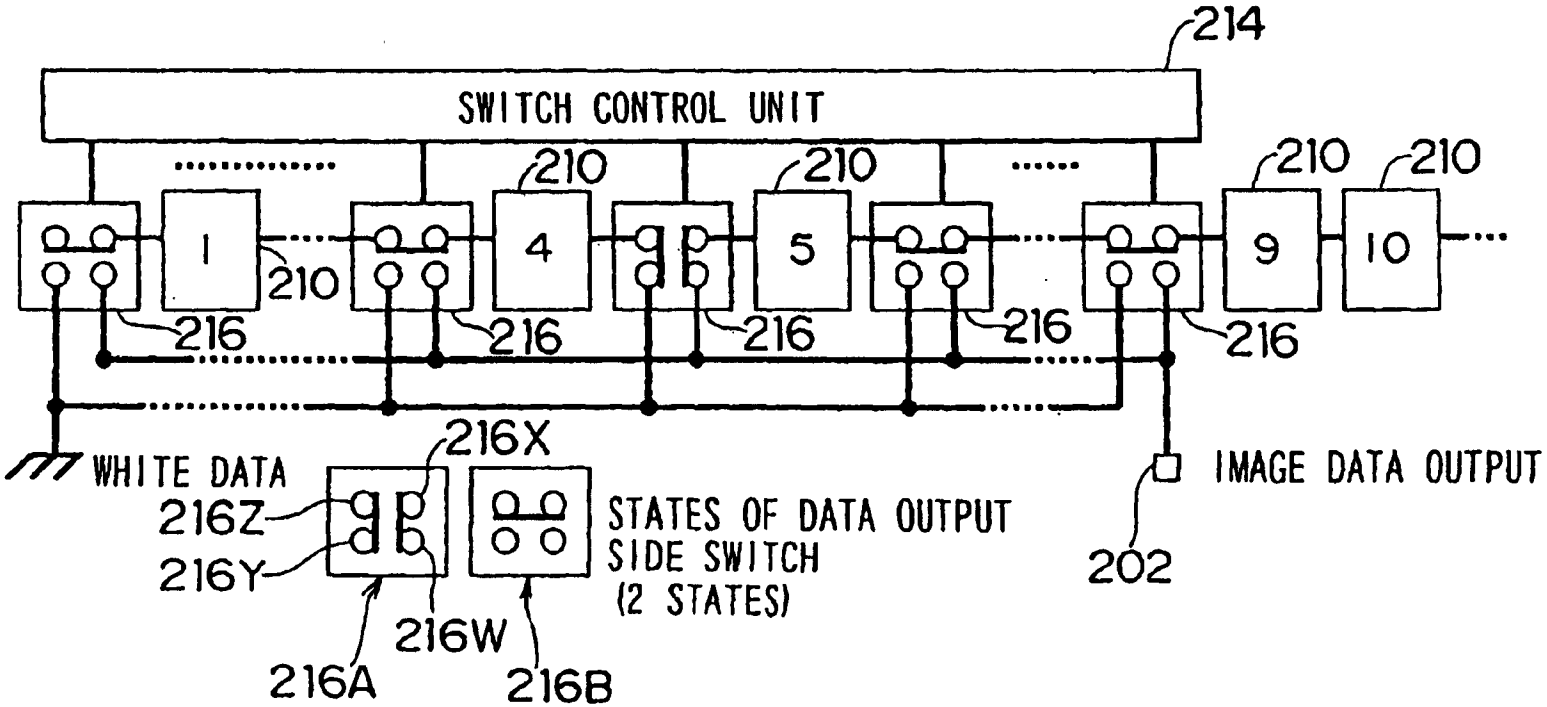
FIG. 20 is a conceptual diagram showing one example of the configuration of a data output side of the generation unit pertaining to the second embodiment.

As shown in FIG. 20, the data output side of the generation unit 19 includes a total of nine switches 216 inserted between each of the shift register 210 components. Each switch 216 is arranged with two input terminals and two output terminals, and is arranged at an input side of each shift register component. Input terminals 216X of the switches 216 are connected to the output sides of the shift register components and other input terminals 216Y of the switches 216 are grounded. Output terminals 216Z of the switches 216 are connected to the data output terminal 202 and other output terminals 216W of the switches 216 are connected to the input sides of the shift register components.

Also, control sides of the switches 216 are connected to the switch control unit 214. The switches 212 have a configuration that is switched by a control signal from the switch control unit 214 to one of a connection state 216A that leads through the output terminal 216Z and the input terminal 216Y and a connection state 216B that leads through the output terminal 216W and the input terminal 216X.

The output terminal 216Z of the switch 216 positioned at the end of the print elements 28 mounted at the printhead 10, i.e., positioned at the output side of the shift register component corresponding to the print element 28 of the element number "1", is open.

The data output sides are also similar to the data input sides, and the switch control unit 214 operates to set the switches 216 to one of the connection states 216A or 216B in accordance with the 3-bit initial value (initial value inputted from the memory unit 16) and insulate and separate the data at the boundaries between the drive print elements 32 and the correction print elements 30 (here, between element number "4" and element number "5").

It should be noted that the shift register components operate by the same clock signal (clock b).

Thus, in the generation unit 19, white data is inputted to the print elements 28 of element number "32" and element number "4" and image data is inputted to element number "28". White data is also inputted to the print elements 28 before element number "4" and the print elements 28 until element number "29". That is, because the output sides of the shift registers 210 are connected to the input sides of the AND elements 24 of the blocks 22 (see FIG. 16), data corresponding to all of the print elements 28 is outputted.

Here, although white data is similarly transferred while all the image data of the twenty-four drive print elements 32 whose data length is a maximum length is transferred, the white data can be prevented from being mixed with the image data because the boundaries between the drive print elements 32 and the correction print elements 30 are insulated and separated by the switches 212 and 216.

It should be noted that the generation unit 19 corresponds to a generation unit of the invention. Also, the shift registers 210 correspond to shift registers of the invention, the switches 212 and 216 correspond to switches of the invention, and the switch control unit 214 corresponds to a switch control unit of the invention.

(Third Embodiment)

In the first and second embodiments, main scanning registration correction and subscanning registration correction were possible by driving the drive print elements 32 and the correction print elements 30 while main scanning in one direction. Incidentally, in two-direction driving that drives while main-scanning in an opposite direction after main-scanning in one direction, displacement of dots to be formed arises in the main scanning directions when the same initial value is used. Thus, in the present embodiment, a case will be described where the invention is applied to a color printer 100 having a two-direction print mode.

It should be noted that, because the present embodiment has the same configuration as that of the first or second embodiment, the same reference numerals will be given to the same portions and detailed description thereof will be omitted. Also, coordinate systems and connection relations described below are one example and are not limited thereto.

Figure 22:
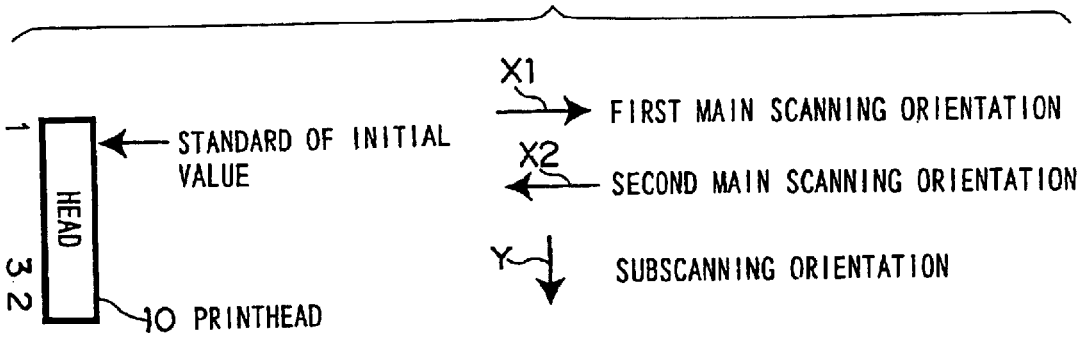
FIG. 22 is a conceptual diagram showing a main scanning direction and the positional relation of the printhead in the third embodiment.

As shown in FIG. 22, the coordinate system of the printhead 10 in the present embodiment is fixed. That is, a first main scanning orientation that is a forward direction is fixed as a main scanning direction X1, a second main scanning orientation that is a reverse direction is fixed as a main scanning direction X2, a subscanning orientation is fixed as a subscanning direction Y, and a standard side of the printhead 10 is fixed as the print element 28 (element number "1") of one end. The print element 28 of the end that is the standard of the initial value of the printhead 10 is fixed as the first drive print element 32 (element number "5") excluding the correction print elements 30.

In the present embodiment, similar to the above-described embodiments, each print element 28 adopts, as a standard, a case where equal element numbers of a remainder with respect to the number of blocks are allocated to the same block (see FIG. 11). Also, assuming interlace driving in an inkjet printer, the connection relations between the decoder 40 and the blocks 22 are set so that the blocks are driven every other three from the end of the drive print elements 32 (see FIG. 12).

Thus, in the case of the main scanning direction X1, the print elements are driven in the order of the fifth, eighth, third, sixth, first, fourth, seventh and second blocks. Thereafter, when the main scanning orientation has been switched to the main scanning direction X2 of the opposite direction, it is necessary to similarly control the drive order for main scanning registration correction so that it becomes the order of the second, seventh, fourth, first, sixth, third, eighth and fifth blocks, which is the opposite order of the main scanning direction X1.

In this case, as described in the preceding embodiments, the initial value corresponding to the main scanning orientation is prepared. Main scanning registration correction becomes possible by changing the initial value in correspondence to each of the main scanning directions X1 and X2.

In this manner, although two different initial values may be switched between in accordance with the main scanning orientations, control becomes complicated. Thus, in the present embodiment, printheads 10 where driving in two directions is enabled by using a single initial value will be described.

Figure 21:
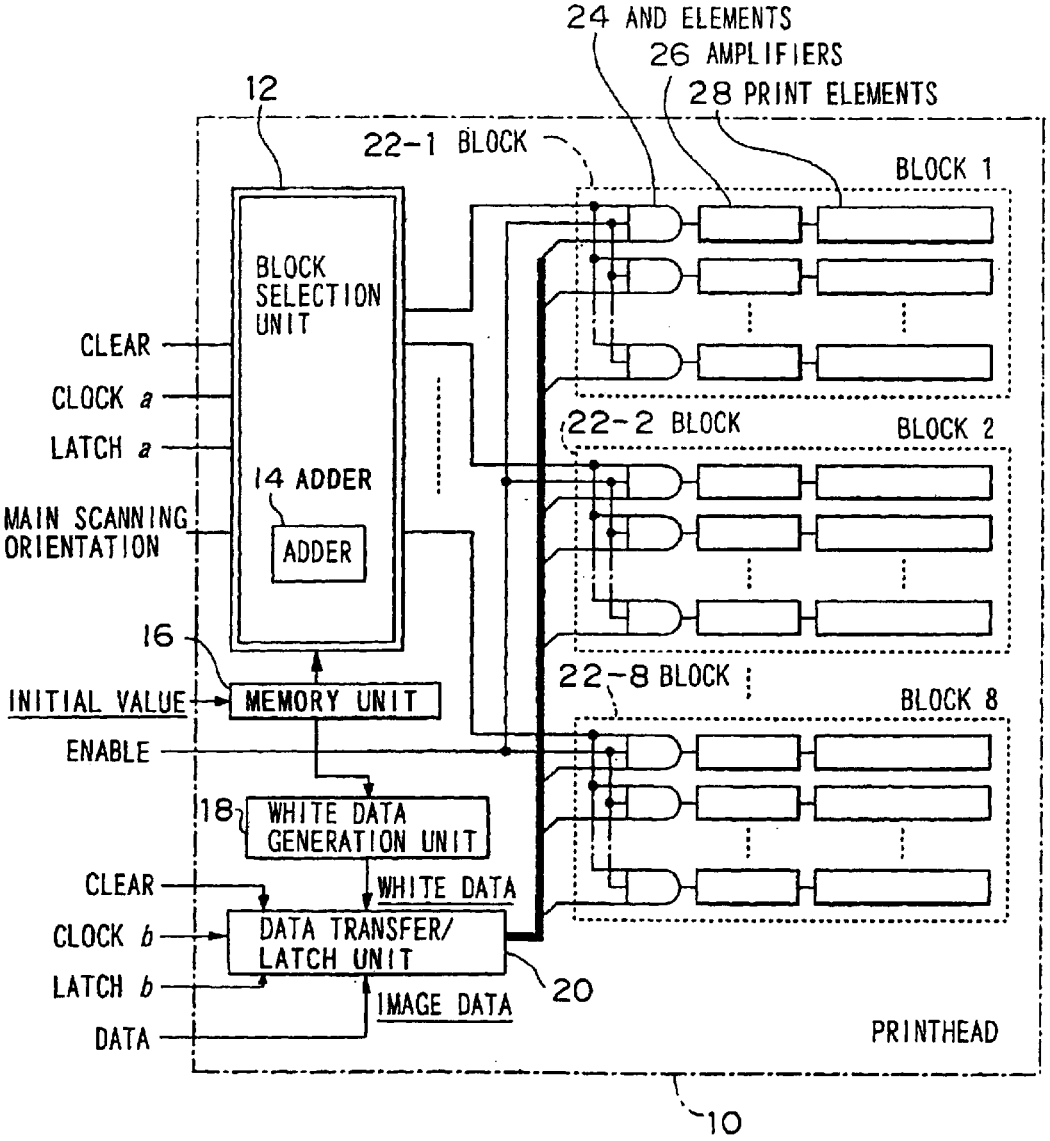
FIG. 21 is a block diagram showing the schematic configuration of a printhead vicinity pertaining to a third embodiment of the invention.

As shown in FIG. 21, the printhead 10 pertaining to the present embodiment has the same configuration as that of the first or second embodiment (see FIG. 1 or FIG. 16), except that the block selection unit 12 is arranged with an adder 14. Also, in the present embodiment, a signal representing the main scanning orientation inputted to the block selection unit 12 is used. An input side of the signal representing the main scanning orientation inputted to the block selection unit 12 corresponds to a direction signal input unit of the invention. Below, the block selection unit 12 of the present embodiment will be described.

Figure 23:
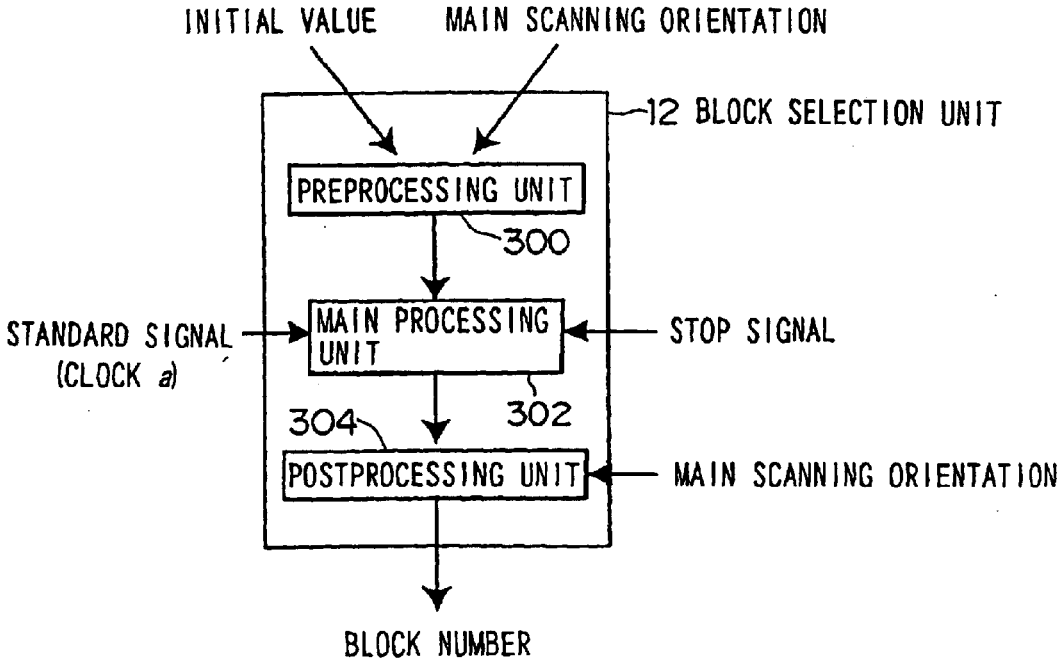
FIG. 23 is a block diagram showing the conceptual configuration of a block selection unit in the third embodiment.

As shown in FIG. 23, the key configuration of the block selection unit 12 includes a preprocessing unit 300, a main processing unit 302 and a postprocessing unit 304. The preprocessing unit 300, the main processing unit 302 and the postprocessing unit 304 correspond to a reciprocal selection unit of the invention.

The preprocessing unit 300 is a processing unit that uses the initial value from the memory unit 16 and the two signals of the main scanning orientations to calculate and output a "true initial value" necessary for the main processing unit 302 (preprocessing operation). The main processing unit 302 has the same configuration as in the first embodiment (see FIGS. 8 and 9). Thus, the standard signal and stop signal of FIG. 23 are shared with the clock. The postprocessing unit 304 is a processing unit that processes a clock signal (clock selection signal) outputted from the main processing unit 302 in accordance with the signal representing the main scanning orientations.

Figure 24:
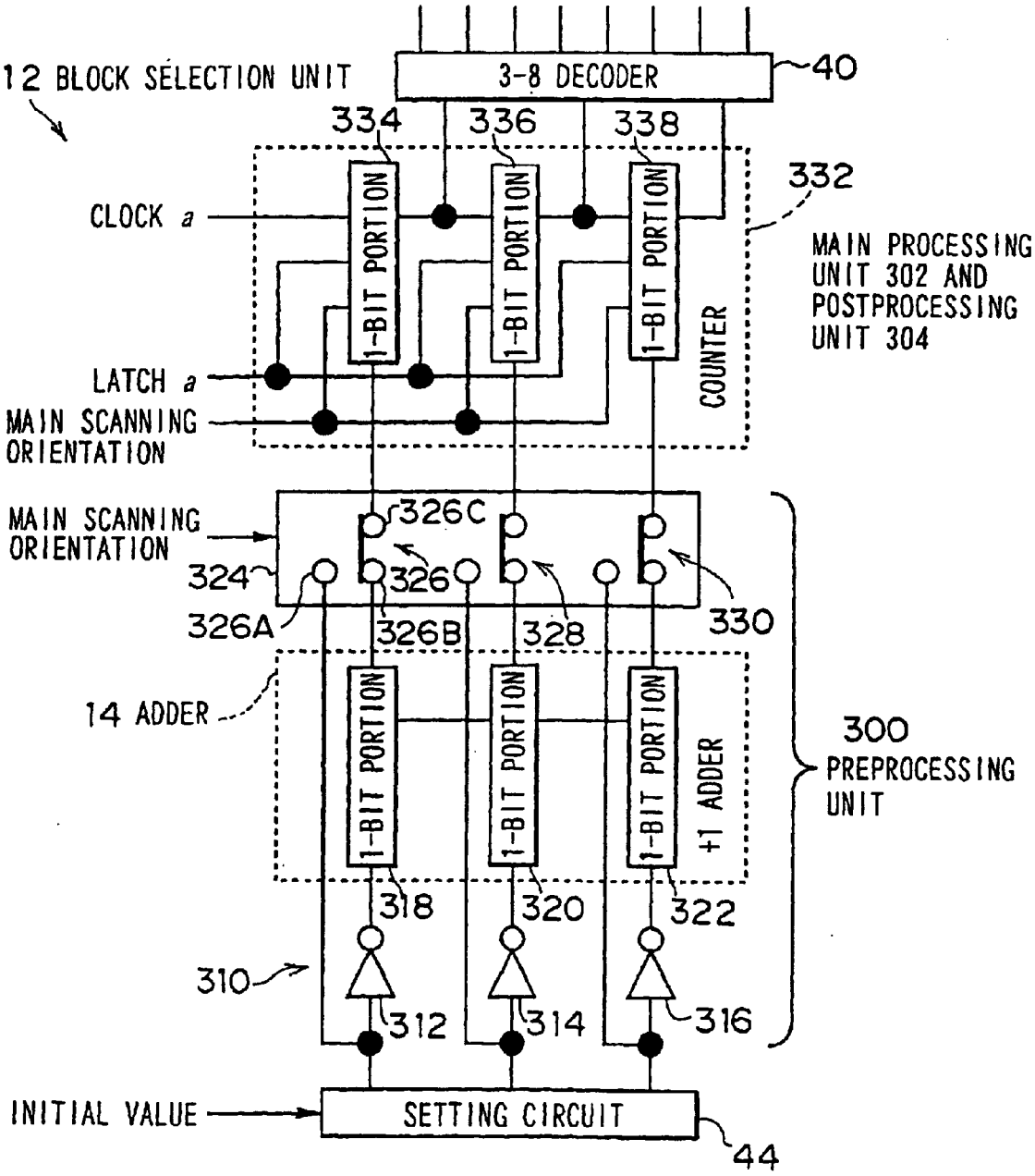
FIG. 24 is a conceptual diagram showing one example of the configuration of the block selection unit in the third embodiment.

As shown in FIG. 24, the block selection unit 12 comprises the setting circuit 44, the preprocessing unit 300 including an adding function, a counter 332 including a latch function corresponding to the main processing unit 302 and the postprocessing unit 304, and the decoder 40. 3-bit serial data inputted in a 3-bit serial format as the initial value is parallel-converted in the setting circuit 44 and the parallel data is outputted to the preprocessing unit 300.

The preprocessing unit 300 is arranged with an inverter 310, the adder 14 and a switch 324. The inverter 310, the adder 14 and the switch 324 are respectively arranged with inverters 312, 314 and 316, +1 adders 318, 320 and 322, and switches 326, 328 and 330 in correspondence with each 1-bit, i.e. inputted, parallel data.

An input side of the inverter 312 is connected to an input end 326A of the switch 326 and an output side of the inverter 312 is connected to another input end 326B of the switch 326 via the +1 adder 318. An output end 326C of the switch 326 is connected to the counter 332. Similarly, input sides of the inverters 314 and 316 are connected to input ends 328A and 330A of the switches 328 and 330, and output sides of the inverters 314 and 316 are connected to other input ends 328B and 330B of the switches 328 and 330 via the +1 adders 320 and 322. Output ends 328C and 330C of the switches 328 and 330 are connected to the counter 332. Also, the +1 adders 318, 320 and 322 are interconnected.

The switch 324 is configured so that the signal representing the main scanning orientation is inputted to a control side thereof. When the signal represents the main scanning direction X1, the switch 324 is switched to a connection state that leads through the input end 326A and the output end 326C (referred to below as a through output mode). When the signal represents the main scanning direction X2, the switch 324 is switched to a connection state that leads through the input end 326B and the output end 326C (referred to below as a complementary output mode). The switches 328 and 330 are also configured to operate similarly.

In the preprocessing unit 300, through data of the initial value outputted from the setting circuit 44 and an initial value generated as "twos complement" by a combination of the inverter 310 and the adder 14 (+1 adder 318, etc.) (referred to below as a complementary initial value) are switched in the switch 324 in accordance with the main scanning orientation and outputted to the counter 332. For example, assuming that the initial value is fixed with respect to the first main scanning direction X1, the preprocessing unit 300 sends, to the main processing unit 302, the through output of the initial value with respect to the main scanning direction X1 and the output of the complementary initial value with respect to the main scanning direction X2.

It should be noted that the configuration in the preprocessing unit 300 that outputs the through data of the initial value corresponds to the configuration of a forward direction order calculation unit of the invention that outputs a value for determining the selection order, the configuration where the "twos complement" is outputted by the combination of the inverter 310 and the adder 14 (+1 adder 318, etc.) corresponds to the configuration of a reverse direction order calculation unit of the invention that outputs a value for determining the selection order, and the switch 324 corresponds to a direction switch of the invention.

The present embodiment does not use a configuration that separates the main processing unit 302 and the postprocessing unit 304 but uses the two-direction counter 332 (described later). It should be noted that the main processing unit 302 and the postprocessing unit 304 may be configured separately.

The counter 332 has substantially the same configuration as that of the counter circuit 46, and is arranged with counter circuits 334, 336 and 338 in correspondence with each of the inputted parallel data. The counter 332 is connected so that the latch a signal and the signal representing the main scanning orientation are commonly inputted to each of the counter circuits 334 to 338, the clock a signal is inputted to the counter circuit 334, the output of the first counter circuit 334 is inputted to the second counter circuit 336, and the output of the second counter circuit 336 is inputted to the third counter circuit 338. Output sides of each of the counter circuits 334 to 338 are connected to the input side of the decoder 40. The counter 332 is configured so that the drive direction of the counter circuits 334 to 338 is reversed in correspondence with the signal representing the main scanning orientation.

Figure 25:
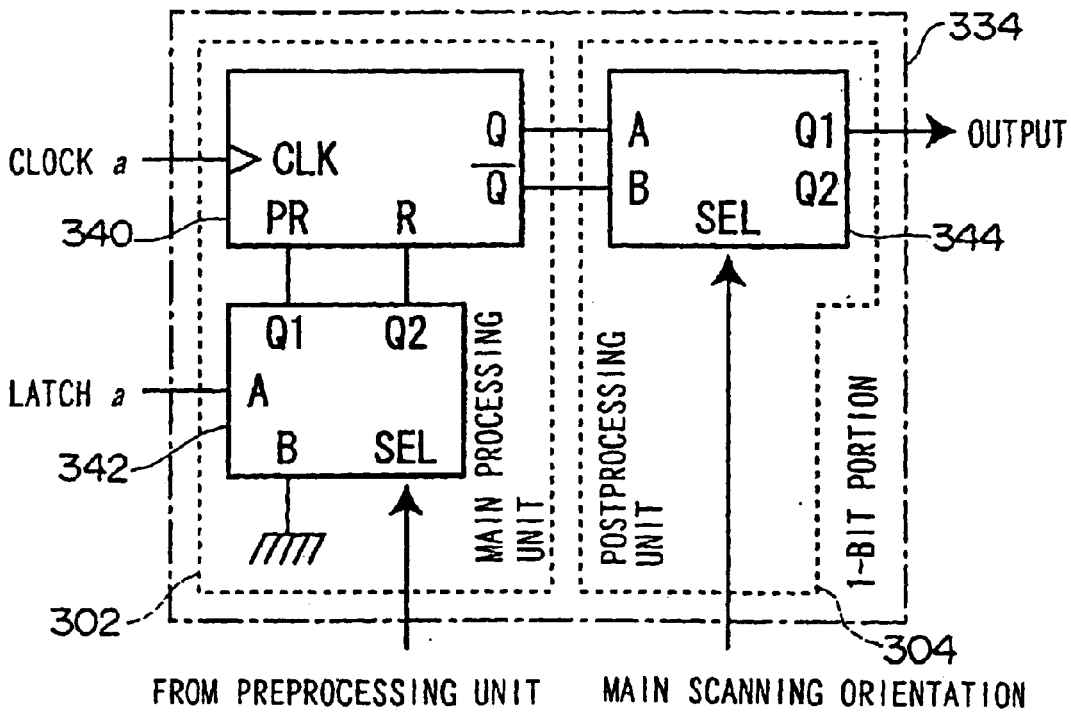
FIG. 25 is a conceptual diagram showing one example of a counter circuit within a counter included in the example of the configuration of the block selection unit.

As shown in FIG. 25, the counter circuit 334 comprises the main processing unit 302 and the postprocessing unit 304. The main processing unit 302 has the same configuration as that of the counter circuit 46 (FIG. 9) and comprises an edge-trigger flip-flop element 340 and a data selector element 342.

The data selector element 342 is connected so that the latch a signal is inputted to an input terminal A of the data selector element 342, and an input terminal B is arranged. An SEL terminal of the data selector element 342 is connected to the output end 326C (switch 324) of the preprocessing unit 300, an output terminal Q1 of the data selector element 342 is connected to a preset terminal PR of the flip-flop element 340, and an output terminal Q2 of the data selector element 342 is connected to a reset terminal R of the flip-flop element 340.

The flip-flop element 340 is connected so that the clock a signal is inputted to a CLK terminal of the flip-flop element 340, the output terminal Q is connected to an input terminal A of a data selector element 344 included in the postprocessing unit 304, and an output terminal Q bar is connected to an input terminal B of the data selector element 344. An SEL terminal of the data selector element 344 is connected so that the signal representing the main scanning orientation is inputted thereto, and an output terminal Q1 is connected to the decoder 40.

As described above, the 1-bit configuration of the main processing unit 302 and the postprocessing unit 304 of the present embodiment comprises two data selectors and the edge-trigger flip-flop. In the postprocessing unit 304, any one of the Q output or the Q bar output of the main processing unit 302 is connected with the Q1 output in accordance with the main scanning orientation. For example, when the main scanning orientation is the first direction (main scanning direction X1), the Q output of the main processing unit 302 is selected, whereby a count-up operation is initiated. When the main scanning orientation is the second direction (main scanning direction X2), the Q bar output of the main processing unit 302 is selected, whereby a count-down operation is initiated.

Next, the action of the block selection unit 12 in the present embodiment will be described.

First, the case where the main scanning orientation is the first direction (main scanning direction X1) will be described. In the preprocessing unit 300, the signal representing the main scanning orientation is inputted, whereby the switch 324 is switched to the through output mode (e.g., the input end 326A and the output end 326C are led through).

Here, the initially selected block is the fifth block 22-5 and the output side of the decoder 40 connected to the fifth block 22-5 is the fourth output side (referred to below as decoder output "4"). For this reason, the initial value is set to "4". This initial value is outputted to the main processing unit 302.

Thus, in the main processing unit 302, the count-up operation is continued by the counter circuits 334 to 338. That is, counting is implemented with respect to the initial value "4" in the order of "4+0", "4+1" and "4+2". In the postprocessing unit 304, counting up is implemented using the Q output of the main processing unit 302. That is, the output of the decoder 40 is selected in the order of the decoder outputs "4", "5" and "6". By repeating this, the decoder output becomes an output that is periodically repeated.

Thus, the print elements 28 are driven in the order of the fifth, eighth, third, sixth, first, fourth, seventh and second blocks.

Next, the case where the main scanning orientation is the second direction (main scanning direction X2) will be described. In the preprocessing unit 302, the signal representing the main scanning orientation is inputted, whereby the switch 324 is switched to the complementary output mode (e.g., the input end 326B and the output end 326C are led through).

Here, the initial value is "4" and twos complement "4" is determined by a complementary operation resulting from the inverter and the +1 adder. That is, as a result of the +1 adder adding "1 (001)" to the inverted value "3 (011)", which is the inverter output of the initial value "4 (100)", "4 (100)" can be obtained. The complement of this initial value is outputted to the main processing unit 302.

In the main processing unit 302, the count-up operation is similarly continued as described above. That is, counting is implemented using "4" as the initial value in the order of "4+0", "4+1" and "4+2". In the postprocessing unit 304, the operation is switched to the count-down operation due to the signal representing the main scanning orientation (main scanning direction X2) being inputted. Thus, in the postprocessing unit 304, counting down is implemented using the Q bar output of the main processing unit 302. That is, the decoder output is selected in the order of "3 (inverse of 4)", "2 (inverse of 5)" and "1 (inverse of 6)".

Thus, the print elements 28 are driven in the order of the second, seventh, fourth, first, sixth, third, eighth and fifth blocks.

In this manner, in the present embodiment, in the case of two-direction mode driving that scans in the second main scanning orientation (main scanning direction X2) after scanning in the first main scanning orientation (main scanning direction X1), the blocks 22 are selected, using the same initial value, in the opposite order of that of the main scanning direction X1 when the main scanning orientation is the main scanning direction X2 and the print elements 28 can be driven. Thus, even if the printer is a two-direction mode printer, main scanning registration correction corresponding to the subscanning registration amount becomes possible using the same initial value.

(Fourth Embodiment)

In the present embodiment, the invention is applied to a color printer 100 having a two-direction print mode of a coordinate system that is different from that of the third embodiment.

It should be noted that, because the present embodiment has the same configuration as that of the third embodiment, the same reference numerals will be given to the same portions and detailed description thereof will be omitted.

Figure 26:
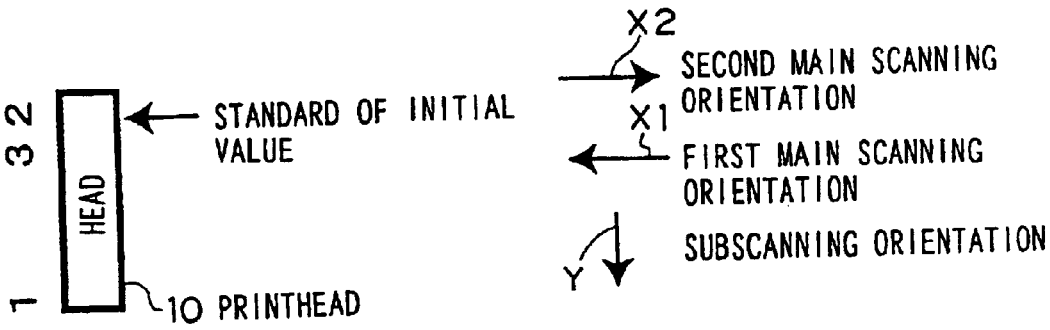
FIG. 26 is a conceptual diagram showing a main scanning direction and the positional relation of a printhead pertaining to a fourth embodiment of the invention.

As shown in FIG. 26, the coordinate system of the printhead 10 in the present embodiment is fixed. That is, in the present embodiment, the printheads are rotated 180 degrees and set so that the orders of the main scanning directions are also reversed. Although the subscanning direction Y is the same direction, the main scanning direction X1 and the main scanning direction X2 are opposite to those of the third embodiment. The standard side of the printhead 10 is fixed to the print element 28 (element number "32") of one end. Also, the print element 28 of the end that is the standard of the initial value of the printhead 10 is fixed to the first drive print element 32 (element number "28") excluding the correction print elements 30.

Figure 27:
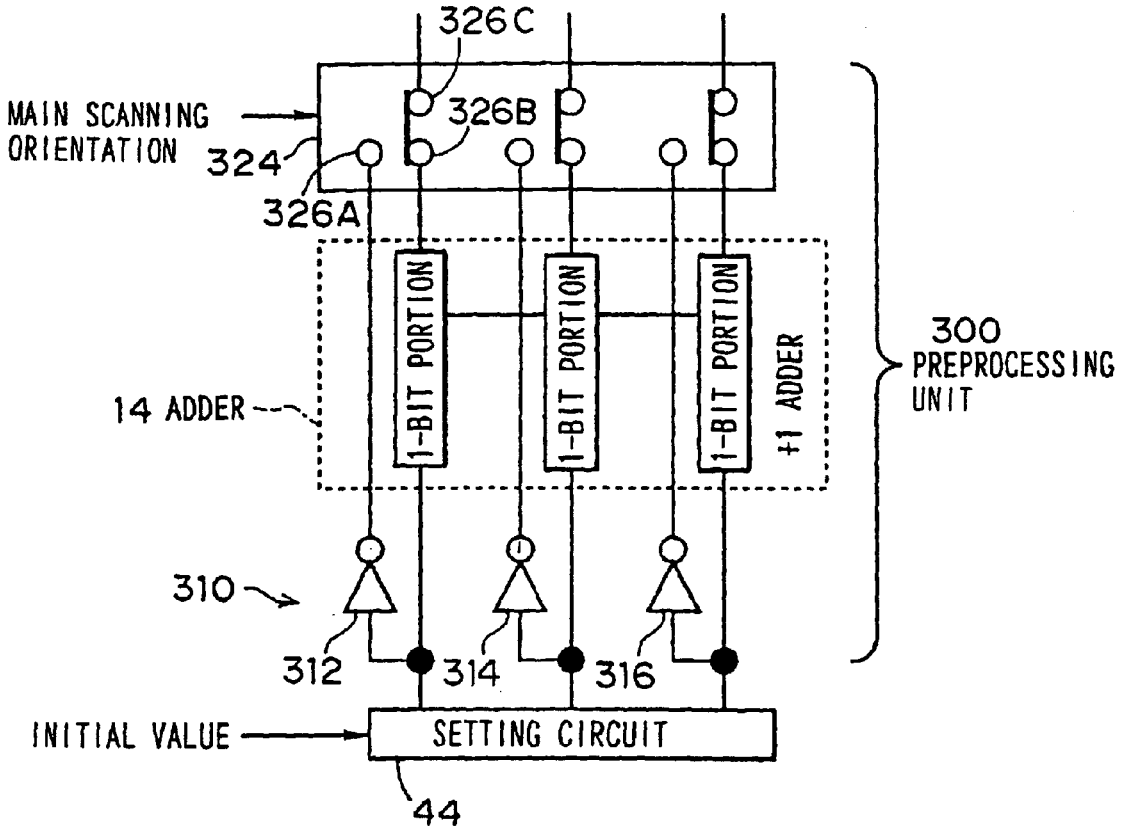
FIG. 27 is a conceptual diagram showing one example of the configuration of a preprocessing unit in the fourth embodiment.

As shown in FIG. 27, in the preprocessing unit 300 of the present embodiment, the output side of the inverter 312 is connected to the input end 326A of the switch 326 and the input side of the inverter 312 is connected to the other input end 326B of the switch 326 via the +1 adder 318. Similarly, output sides of the inverters 314 and 316 are connected to input ends 328A and 330A of the switches 328 and 330, and input sides of the inverters 314 and 316 are connected to the other input ends 328B and 330B of the switches 328 and 330 via the +1 adders 320 and 322.

The switch 324 is configured so that the signal representing the main scanning orientation is inputted to the control side thereof. When the signal represents the main scanning direction X2, the switch 324 is switched to a connection state that leads through the input end 326A and the output end 326C (referred to below as a reverse output mode). When the signal represents the main scanning direction X1, the switch 324 is switched to a connection state that leads through the input end 326B and the output end 326C (referred to below as an addition output mode). The switches 328 and 300 are also configured to operate similarly.

That is, the preprocessing unit 300 of the present embodiment has a configuration that is equivalent to a case where, in the third embodiment, the initial value is reversed and inputted to the setting circuit 44. Thus, any of a reverse output or a +1 addition output of the initial value is sent to the main processing unit 302.

The initial value inputted to the setting circuit 44 is fixed to instruct the end of the standard side of the drive print elements 32, i.e., the fourth block 22-4 belonging to the print element 28 of element number 28. That is, because the decoder output connected to the fourth block is "1" (FIG. 12), the initial value is set to "1".

Next, the driving of the print elements 28 will be described.

In the present embodiment, because the printheads are rotated 180 degrees, the print elements are driven in reverse order from element number "28" to element number "5" of the drive print elements 32. For this reason, with respect to the print elements 28, in accordance with the allocation (FIG. 11) and connection relations (FIG. 12) of blocks that are driven every other three from the end, it is necessary to drive the print elements 28 in the order of the fourth, first, sixth, third, eighth, fifth, second and seventh blocks in the main scanning direction X2.

Thus, the case where the main scanning orientation is the second direction, i.e., the main scanning direction X2 (equal to the main scanning direction X1 that is the first main scanning orientation in the third embodiment), will first be described. In the preprocessing unit 300, the signal representing the main scanning orientation is inputted, whereby the switch 324 is switched to the reverse output mode (e.g., the input end 326A and the output end 326C are led through).

As mentioned above, the initially selected block is the fourth block 22-4 and the output side of the decoder 40 connected to the fourth block 22-4 is the decoder output "1". For this reason, the initial value is set to "1". The inverse value of this initial value is outputted to the main processing unit 302. That is, in the preprocessing unit 300, the inverse output of the initial value is outputted via the inverter 310. Here, it is set to the inverse of "1 (001)", "6 (110)".

Thus, similar to what was described above, in the main processing unit 302, counting is implemented, using "6" as the initial value, in the order of "6+0", "6+1" and "6+2". In the postprocessing unit 304, counting down is implemented using the Q bar output of the main processing unit 302. That is, the decoder output is selected in the order of "1 (inverse of 6)", "0 (inverse of 7)" and "7 (inverse of 0)".

Thus, the print elements 28 are driven in the order of the fourth, first, sixth, third, eighth, fifth, second and seventh blocks.

In the case where the main scanning orientation is the first scanning direction, i.e., the main scanning direction X1 (equal to the main scanning direction X2 that is the second main scanning orientation in the third embodiment), in the preprocessing unit 300, the signal representing the main scanning orientation is inputted, whereby the switch 324 is switched to the addition output mode (e.g., the input end 326B and the output end 326C are led through).

Here, the initial value is "1", and "2" is determined by a calculation of the +1 adder. That is, as a result of the +1 adder adding "1(001)" to the initial value "1 (001)", "2 (010)" can be obtained. The added value of this initial value is outputted to the main processing unit 302.

In the main processing unit 302, the count-up operation is similarly continued as described above. That is, counting is implemented using "2" as the initial value in the order of "2+0", "2+1" and "2+2". In the postprocessing unit 304, the operation is switched to the count-up operation due to the signal representing the main scanning orientation (corresponding to the main scanning direction X1) being inputted. Thus, in the postprocessing unit 304, counting up is implemented using the Q output of the main processing unit 302. That is, the decoder output is selected in the order of "2", "3" and "4".

Thus, the print elements 28 are driven in the order of the seventh, second, fifth, eighth, third, sixth, first and fourth blocks.

In this manner, in the present embodiment, in the case of two-direction mode driving that scans using the printhead 10 of the reversed coordinate system, the blocks 22 are selected, using the same initial value, in the opposite order of that of the main scanning direction X1 when the main scanning orientation is the main scanning direction X2, and the print elements 28 can be driven. Thus, even if the printer is a two-direction mode printer, main scanning registration correction corresponding to the subscanning registration amount becomes possible using the same initial value, regardless of the involvement in the coordinate system.

It should be noted that, in the present embodiment, a case was described where the configuration of the preprocessing unit 300 was changed because the invention was applied to a color printer 100 having a two-direction print mode of a different coordinate system. However, as shown in FIG. 28, the same effects can be obtained by reallocating the connection relations of the print elements 28 included in the drive print elements 32.

That is, as shown in FIG. 28, using the block selection order resulting from the block selection unit 12 as a size order of the blocks, the order of block selection and the relative element numbers of the print elements 28 are fixed in advance. In FIG. 28, absolute orientations of main scanning are shown in the selection order column. That is, the selection order shows the correspondence of one direction and two directions. In the case of two directions, the selection order of the opposite direction is shown in parentheses because it is necessary to reverse the selection order to the reverse direction with respect to the forward direction.

For example, in the third embodiment, because the element numbers "5", "6", "7", . . . , "28" of the print elements correspond to the drive print elements 32, they are made to correspond to the relative element numbers *1, *2, *3, . . . , *24.

In the present fourth embodiment, because the element numbers "28", "27", "26", . . . , "5" of the print elements correspond to the drive print elements 32, they are made to correspond to the relative element numbers *1, *2, *3, . . . , *24 (reallocation of FIG. 28).

Thus, the selection orders of the print elements 28 both become the same, and the positions on the recording medium (paper P) do not change even if the printheads 10 are rotated 180 degrees.

(Fifth Embodiment)

The present embodiment can apply any of the first through fourth embodiments, and because the present embodiment has the same configuration as that of the preceding embodiments, the same reference numerals will be given to the same portions and detailed description thereof will be omitted.

In the present embodiment, description will be given, with respect to the subscanning registration correction amount, by way of example of respectively different cases where the printhead 10A is zero and the printhead 10B is minus one element. In this case, the drive print elements of the printhead 10A are element numbers "5" to "28" and the drive print elements of the printhead 10B are element numbers "4" to "27".

In the above-described embodiments, a case was assumed where the printheads 10 are arranged so that the arranging directions of the print elements 28 are substantially parallel and their relative positional relations are substantially the same to obtain a single print band $W_P$ (see FIG. 6). In this case, the print band $W_P$ is restricted by the number of print elements 28 in the printheads 10.

Figure 29:
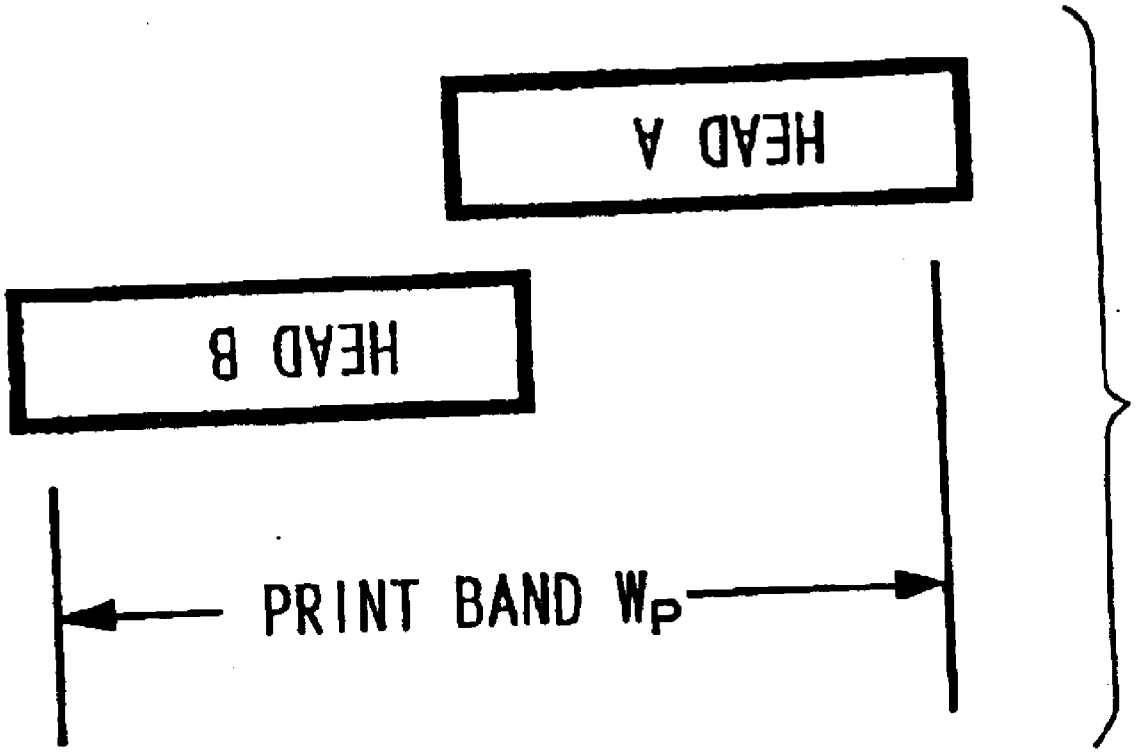
FIG. 29 is a conceptual diagram showing the positional relation of printheads pertaining to a fifth embodiment of the invention.

Thus, as shown in FIG. 29, the present embodiment adopts a staggered arrangement where the printheads 10 are arranged so that they are relatively shifted in the subscanning direction in order to widen the single print band $W_P$.

Figure 30:
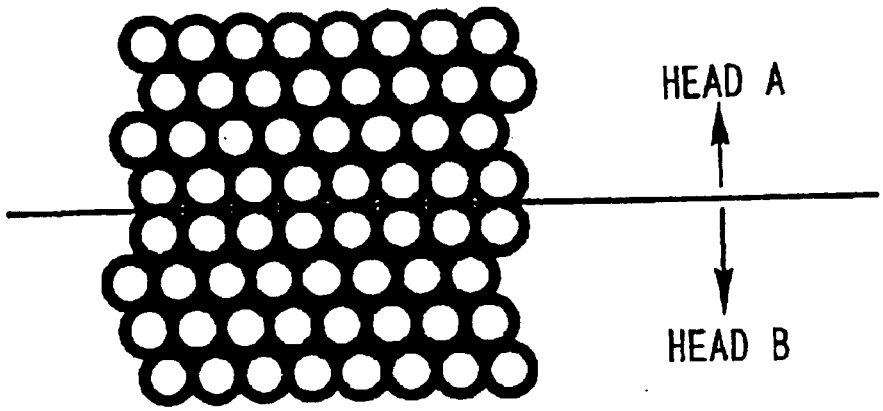
FIG. 30 is an explanatory diagram of how periodicity of dot positions in a subscanning direction on a recording medium is lost at head boundaries in the fifth embodiment.

However, because the single print band $W_P$ is configured by the plural printheads 10 when the printheads 10 are staggered and driven, there is the potential for the periodicity of dot positions in the subscanning direction on the recording medium to be lost at head boundaries (see FIG. 30). When disruption of this periodicity occurs, sometimes the dots are visible as striped image defects in the main scanning direction.

Thus, in the present embodiment, print elements 28 equal to an integral multiple of the number of blocks and fewer than the number of mounted print elements 28 are set in advance as the drive print elements 32.

Figure 31:
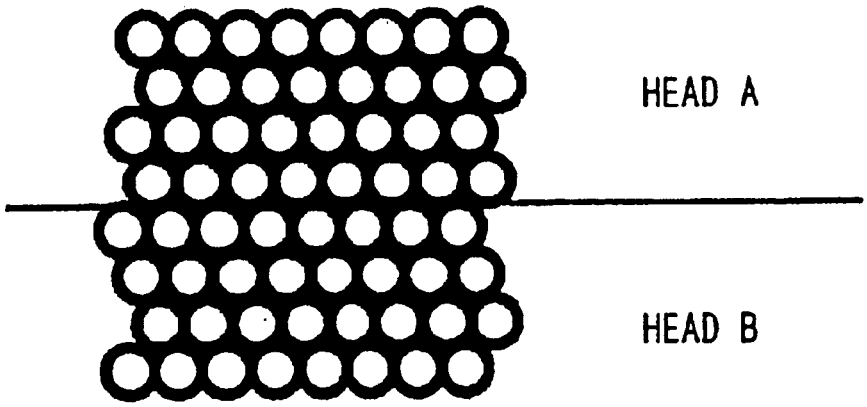
FIG. 31 is an explanatory diagram of how periodicity of dot positions in the subscanning direction on the recording medium is maintained in the fifth embodiment.

In this manner, by setting the number of drive print elements 32 to a number equal to an integral multiple of the number of blocks, periodicity with regard to each of the printhead 10A and the printhead 10B becomes the same and periodicity of dot positions with respect to each printhead 10 is completed within the heads. Thus, as shown in FIG. 31, disruption of dot position periodicity can be prevented.

After the above-described setting, the initial values of the printheads 10 are set and the print elements 28 are driven similar to the preceding embodiments.

For example, the initial value of the printhead 10A is set so that the fifth block is initially selected and the print elements 28 are driven in the selection order of the fifth, eighth, third, sixth, first, fourth, seventh and second blocks. The print elements 28 are also driven in the reverse order. In the printhead 10B, the initial value is set so that the fourth block is initially driven and the print elements 28 are driven in the selection order of the fourth, seventh, second, fifth, eighth, third, sixth and first blocks. The print elements 28 are also driven in the reverse order.

It should be noted that, as mentioned above, effects similar to the above can also be obtained by reallocating (see FIG. 28) the connection relations of the print elements 28 included in the drive print elements 32.

For example, in regard to the printhead 10A, because the element numbers "5", "6", "7", . . . , "28" of the print elements 28 correspond to the drive print elements 32, they are made to correspond to the relative element numbers *1, *2, *3, . . . , *24. Additionally, in regard to the printhead 10B, because the element numbers "4", "5", "6", . . . , "27" of the print elements 28 correspond to the drive print elements 32, they are made to correspond to the relative element numbers *1, *2, *3, . . . , *24.

Thus, because the selection orders of the print elements 28 become the same between the heads, dot position periodicity is preserved regardless of the subscanning registration correction amount.

(Sixth Embodiment)

The present embodiment can apply any of the third through fifth embodiments, and because the present embodiment has the same configuration as that of the preceding embodiments, the same reference numerals will be given to the same portions and detailed description thereof will be omitted.

In the present embodiment, description will be given, with respect to the subscanning registration correction amount, by way of example of respectively different cases where the printhead 10A is zero and the printhead 10B is minus one element. In this case, the drive print elements of the printhead 10A are element numbers "5" to "28" and the drive print elements of the printhead 10B are element numbers "4" to "27".

In the above-described embodiments, a case was assumed where the printheads 10 are arranged so that the arranging direction of the print elements 28 are substantially parallel and the arranging directions of the elements numbers of the print elements 28 are substantially the same (see FIGS. 6 and 29). However, when the plural printheads 10 are mounted, it is preferable to arrange the printheads 10 so that mutual printheads 10 face each other from the standpoint of the ease of wiring connection wires such as leads that are pulled out from the printheads 10.

Figure 32:
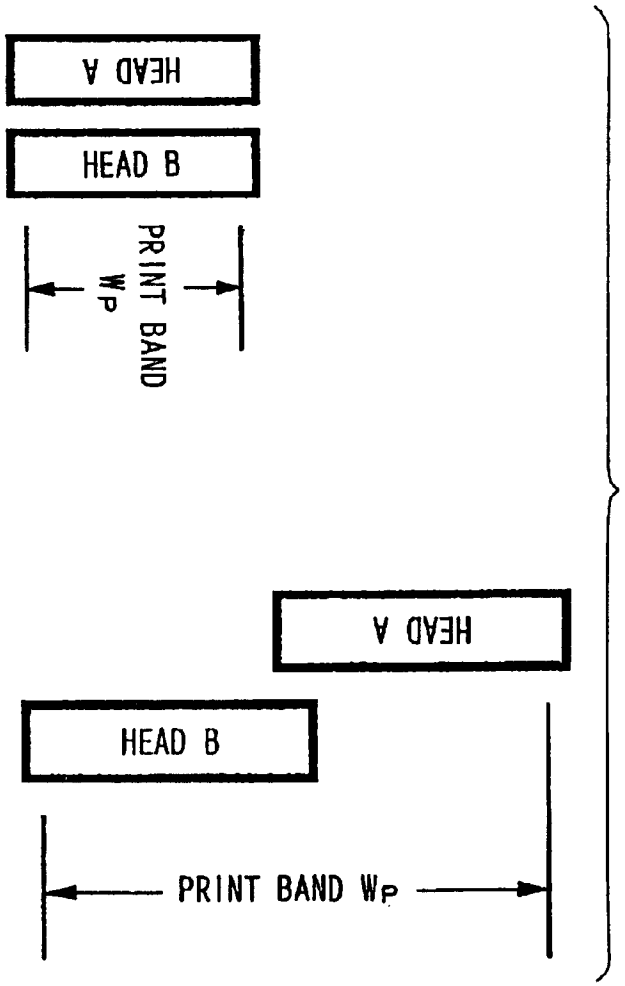
FIG. 32 is a conceptual diagram showing the positional relation of printheads pertaining to a sixth embodiment of the invention.

Thus, as shown in FIG. 32, in the present embodiment, the printhead 10A and the printhead 10B are arranged so that the arranging directions of element numbers are in opposite directions, i.e., so that mutual printheads 10 face each other.

That is, in the case of the disposition of the left column of FIG. 32, the print elements 28 of the printhead 10A may be selected similar to the third embodiment, or the print elements 28 of the printhead 10B may be selected similar to the fourth embodiment.

For example, when the printhead 10A has the orientation of the third embodiment, the initial value thereof is set so that the fifth block is initially selected and the print elements 28 are driven in the selection order of the fifth, eighth, third, sixth, first, fourth, seventh and second blocks.

When the printhead 10B has the orientation of the third embodiment (same orientation as the fourth embodiment), it is necessary to initially select the end of the drive print elements 32, i.e., the block to which the print element 28 of element number "27" belongs. More specifically, it is necessary for the selection order to be the third, eighth, fifth, second, seventh, fourth, first and sixth blocks.

Thus, the initial value inputted to the setting circuit 44 becomes the opposite order, or "7", which is equal to the decoder output connected to the sixth block. The value sent from the preprocessing unit 300 to the main processing unit 302 becomes "1", which is equal to twos complement of "7 (111)".

When the printhead 10A has the opposite orientation of the third embodiment (same orientation as the fourth embodiment), the initial value is set so that the second block is initially selected and the print elements are driven.

In this case, when the printhead 10B has the orientation of the third embodiment, the initial value is "6", which is equal to the decoder output connected to the third block. The value sent from the preprocessing unit 300 to the main processing unit 302 becomes "1", which is equal to the inverse of "6 (110)".

It should be noted that, because the operation following the main processing unit 302 with respect to the absolute orientation of main scanning is the same as those of the third and fourth embodiments, the selection order can be fixed to a desired order whichever is used. It goes without saying that it is also possible to apply the present embodiment to the fifth embodiment.

(Seventh Embodiment)

In the present embodiment, large-scale printheads can be configured by combining the above-described embodiments. This combination will be described below.

Figure 33A:
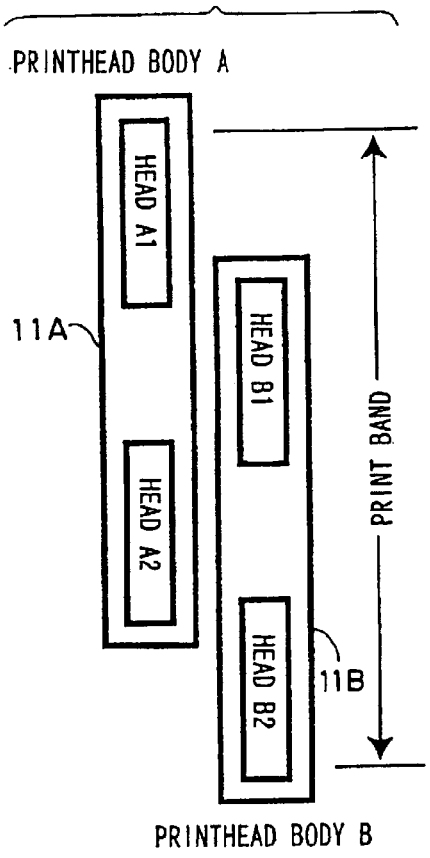
FIGS. 33A and 33B are conceptual diagrams showing the positional relation of first printheads pertaining to a seventh embodiment of the invention.
Figure 33B:
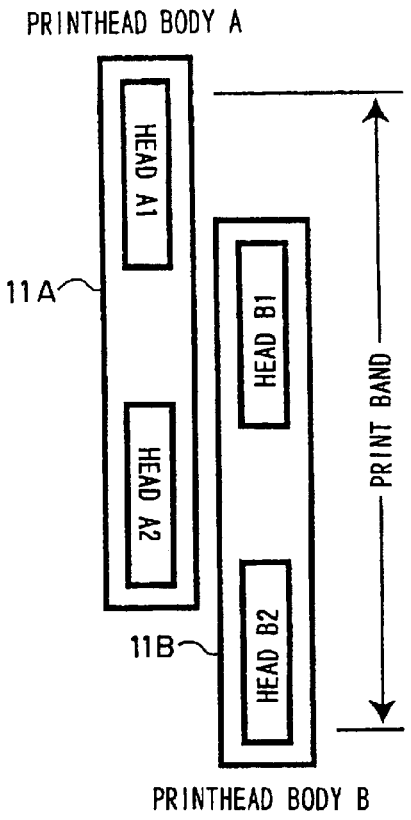

In FIGS. 33A and 33B, examples are illustrated where a printhead body 11A, in which plural printheads 10A1 and 10A2 are separated in the arranging direction of the print elements 28, and another similar printhead body 11B are arranged in a staggered manner so that they are relatively shifted in the subscanning direction. In FIG. 33A, the arranging directions of the print elements 28 are the same, and in FIG. 33B, the arranging directions of the print elements 28 are different between the printhead bodies.

In the example of FIG. 33A, the relation between the printhead 10A1 and the printhead 10B1, the relation between the printhead 10B1 and the printhead 10A2 and the relation between the printhead 10A2 and the printhead 10B2 have the positional relation of the printheads 10 described in the fifth embodiment.

In the example of FIG. 33B, the relation between the printhead 10A1 and the printhead 10B1, the relation between the printhead 10B1 and the printhead 10A2 and the relation between the printhead 10A2 and the printhead 10B2 have the positional relation of the printheads 10 described in the sixth embodiment.

Figure 34A:
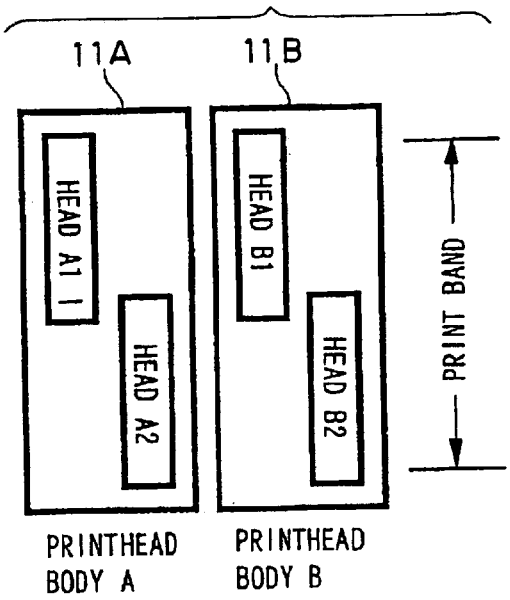
FIGS. 34A and 34B are conceptual diagrams showing the positional relation of second printheads pertaining to the seventh embodiment of the invention.
Figure 34B:
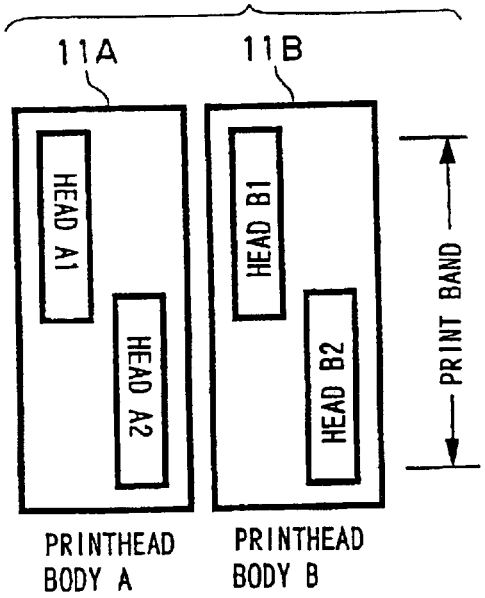

In FIGS. 34A and 34B, examples are illustrated where a printhead body 11A, in which plural printheads 10A1 and 10A2 are alternately arranged to be substantially parallel in the arranging direction of the print elements 28, and another similar printhead body 11B are arranged so that their relative positional relations in the subscanning direction are substantially the same. In FIG. 34A, the arranging directions of the print elements 28 are the same, and in FIG. 34B, the arranging directions of the print elements 28 are different between the printhead bodies.

In FIG. 34A, the relation between the printhead body 11A and the printhead body 11B has the positional relation of the printheads 10 described in the first through fifth embodiments. In FIG. 34B, the relation between the printhead body 11A and the printhead body 11B has the positional relation of the printheads 10 described in the sixth embodiment. The relations between the printheads in the printhead bodies have the relations described in the fifth embodiment.

Figure 35A:
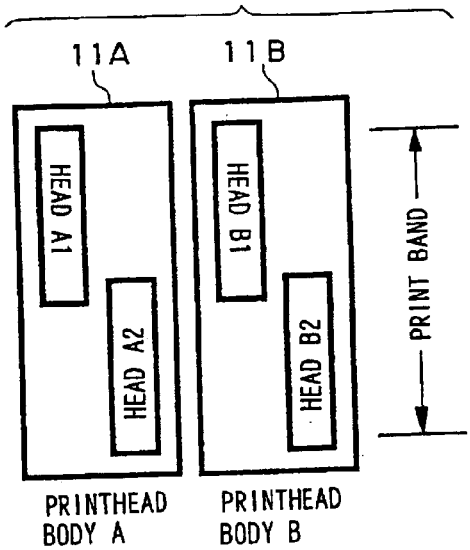
FIGS. 35A and 35B are conceptual diagrams showing the positional relation of third printheads pertaining to the seventh embodiment of the invention.
Figure 35B:
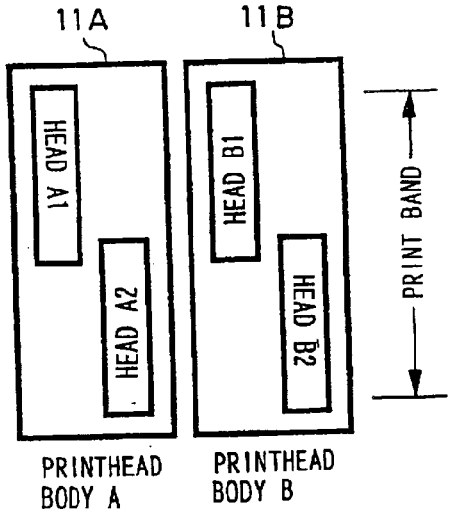
Figure 36:
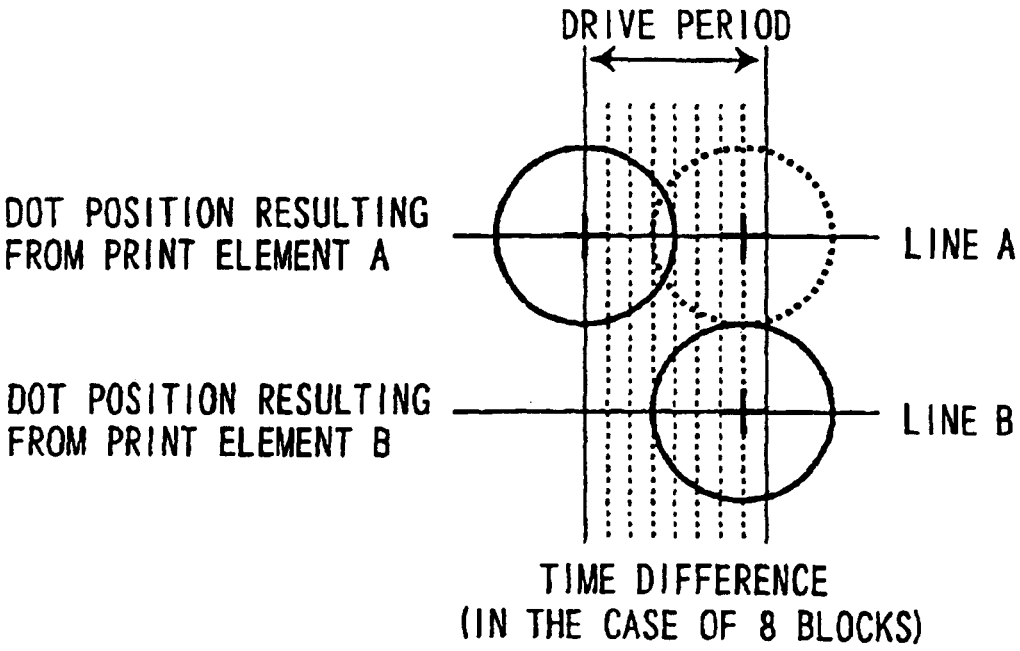
FIG. 36 PRIOR ART
FIG. 36 is a conceptual diagram directed to dots in a main scanning direction in conventional plural printheads.

In FIGS. 35A and 35B, examples are illustrated where a printhead body 11A, in which plural printheads 10A1 and 10A2 are alternately arranged in mutually different directions to be substantially parallel in the arranging direction of the print elements 28, and another similar printhead body 11B are arranged so that their relative positional relations in the subscanning direction are substantially the same. In FIG. 35A, the same printhead disposition is adopted in each of the printheads 11A and 11B, and in FIG. 35B, a different disposition is adopted.

In FIG. 35A, the relation between the printhead 10A1 and the printhead 10A2 and the relation between the printhead 10B1 and the printhead 10B2 in the printhead body 11A and the printhead body 11B have the positional relations of the printheads 10 described in the sixth embodiment. In FIG. 35B, the printheads in the printhead body 11B have a positional relation where the printheads 10 are reversed.

When the printhead bodies are configured in this manner by plural printheads, dot position periodicity with respect to the subscanning direction on the recording medium is preserved by applying the above-described embodiments. Thus, the printheads themselves can be viewed as one printhead.

Thus, including all of the printhead dispositions assumed in the embodiments described up to now, the present invention can be easily applied to a case where the head bodies are recursively combined using these as one unit to configure a large-scale printhead body.

What is claimed is:

1. A printhead, comprising:

plural recording elements that are divided into plural blocks and driven per divided block;

an input unit for inputting an initial value of a selection order of the blocks in order to drive the recording elements; and a selection unit that selects, on the basis of the inputted initial value, the blocks for driving the recording elements according to the selection order of the blocks, wherein a memory unit keeps the initial value and outputs the kept initial value to the selection unit.

2. The printhead of claim 1, wherein the selection unit includes a repeat selection unit that autonomously and periodically repeats the selection order using an inputted signal.

3. The printhead of claim 2, wherein the repeat selection unit includes a synthesizing unit that generates a synthesized signal in which enable signals of the recording elements are synthesized, and autonomously and periodically repeats the selection order using the synthesized signal.

4. The printhead of claim 3, wherein each recording element includes a product calculation unit having, as inputs, a selection instruction signal of the selection unit, a synthesized signal of the synthesizing unit and a recording signal for recording at each element, and having, as an output, an AND operation of the inputs.

5. The printhead of claim 2, wherein the repeat selection unit includes a counter that successively counts the initial value in accordance with an inputted clock signal.

6. The printhead of claim 1, wherein, when a new initial value is inputted to the memory unit, the memory unit updates the initial value to the new initial value.

7. The printhead of claim 1, further comprising a generation unit that generates, when recording elements of a number that is less than the number of the plural recording elements are set as drive elements, non-drive data for placing recording elements other than the drive elements in a non-driven state.

8. The printhead of claim 7, wherein the generation unit comprises shift registers comprising components corresponding to each of the recording elements, a switch that is switched, by an inputted connection signal, between a first connection state connected to the neighbor component and a second connection state connected to a non-drive data generator, and a switch control unit that outputs a connection signal on the basis of position data representing positions of the drive elements.

9. The printhead of claim 8, wherein the second connection state connected to the non-drive data generator is grounded.

10. The printhead of claim 1, wherein the selection unit includes a direction signal input unit for inputting a direction signal representing a main scanning orientation when the recording elements are relatively moved and main-scanned, with respect to a recording medium, in a direction intersecting an arranging direction of the recording elements, and a reciprocal selection unit that selects the blocks in a selection order of the blocks on the basis of the initial value when the main scanning orientation is a first direction and selects the blocks in a reverse order of the selection order when the main scanning orientation is a direction opposite to the first direction.

11. The printhead of claim 10, wherein the reciprocal selection unit includes a forward direction order calculation unit that determines the selection order of the blocks on the basis of the initial value in the case of the first direction, a reverse direction order calculation unit that determines the reverse selection order of the blocks by adding to the initial value in the case of the opposite direction, and a direction switch that uses the direction signal to switch to the forward direction order calculation unit or the reverse direction order calculation unit.

12. The printhead of claim 11, wherein the reciprocal selection unit includes a counter that successively counts in accordance with a clock signal to which the initial value is inputted, and the forward direction order calculation unit or the reverse direction order calculation unit outputs an added value resulting from a +1 counter to the counter.

13. A recording device comprising:

plural printheads in order to record an image on a recording medium, the plural printheads comprising a first printhead and a second printhead, wherein each of the first and second printheads includes plural recording elements that are divided into plural blocks and driven per divided block, an input unit for inputting an initial value of a selection order of the blocks in order to drive the recording elements, and a selection unit that selects, on the basis of the inputted initial value, the blocks for driving the recording elements according to the selection order of the blocks, with recording elements of a number that is less than the number of plural recording elements being set as drive elements, wherein a printhead group arranged with the first printhead and the second printhead is formed so that so that at least parts of relative positions in an arranging direction of the recording elements of the drive elements of the first printhead and the drive elements of the second printhead are overlapped; and a setting unit that sets a first initial value defining a selection order of the blocks corresponding to positions of the drive elements of the recording elements of the first printhead and sets a second initial value defining a selection order of the blocks corresponding to a displacement amount of positions of the drive elements of the recording elements of the second printhead with respect to positions of the drive elements of the recording elements of the first printhead.

14. The recording device of claim 13, wherein, when the printhead group is arranged so that parts of the relative positions in the arranging direction of the recording elements of the drive elements of the first printhead and the drive elements of the second printhead are overlapped, the number of the drive elements is set to an integral multiple of the number of blocks.

15. The recording device of claim 13, wherein the printhead group is characterized in that the first printhead and the second printhead are staggeringly arranged.

16. The recording device of claim 13, wherein the printhead group is characterized in that the arranging directions of the recording elements of each of the first printhead and the second printhead are reversed.

17. The recording device of claim 13, wherein at least one printhead of the first printhead and the second printhead includes plural recording element groups in the arranging direction of the recording elements.

18. The recording device of claim 17, wherein the plural recording element groups of at least one printhead of the first printhead and the second printhead include different recording element arranging directions.

19. The recording device of claim 13, wherein at least one printhead of the first printhead and the second printhead includes recording elements in each of plural directions parallel to the arranging direction of the recording elements.

20. The recording device of claim 19, wherein the plural recording element groups of the at least one printhead of the first printhead and the second printhead include different recording element arranging directions.

21. The recording device of claim 13, wherein the printheads are recording medium-width recording printheads in which the recording elements are arranged so that they reach a length corresponding to the width of a recording medium.

22. The recording device of claim 13, wherein the printheads are inlet recording printheads that record by ejecting ink.

* * * * *